US005602565A

United States Patent [19]

Takeuchi

[11] Patent Number: 5,602,565

[45] Date of Patent: Feb. 11, 1997

[54] METHOD AND APPARATUS FOR DISPLAYING VIDEO IMAGE

[75] Inventor: Kesatoshi Takeuchi, Suwa, Japan

[73] Assignee: Seiko Epson Corporation, Tokyo, Japan

[21] Appl. No.: 312,615

[22] Filed: Sep. 27, 1994

[30] Foreign Application Priority Data

Sep. 27, 1993 [JP] Japan ..... 5-264251

[51] Int. Cl.[6] ..... G09G 5/14

[52] U.S. Cl. ..... 345/119; 345/115

[58] Field of Search ..... 345/119, 120, 345/115, 113, 112; 348/584, 585

[56] References Cited

U.S. PATENT DOCUMENTS

| | | | |
|---|---|---|---|
| 4,509,043 | 4/1985 | Mossaides | 345/113 |
| 4,559,533 | 12/1985 | Bass et al. | 345/120 |
| 4,602,286 | 7/1986 | Kellar et al. | 348/584 |
| 4,992,781 | 2/1991 | Iwasaki et al. | 348/584 |
| 5,268,762 | 12/1993 | Hasegawa et al. | 348/584 |

FOREIGN PATENT DOCUMENTS 62-278683 12/1987 Japan .

*Primary Examiner*—Richard Hjerpe
*Assistant Examiner*—Regina Liang
*Attorney, Agent, or Firm*— Oblon, Spivak, McClelland, Maier & Neustadt, P.C.

[57] ABSTRACT

A video display apparatus of the present invention simultaneously displays a plurality of video images, which are overlapping with one another, on a display screen as a function of video data read out of a plurality of video memories without transferring the video data among the video memories. The video display apparatus includes three memory control units 71–73, which output clock signals CLK1 through CLK3 synchronous with three video signals RGB01-3 read out of three video memory units 61–63, respectively. A video signal switching unit 82 selects one of the three video signals while a clock signal switching unit 4 selects one of the three clock signals. A digital-to-analog converter 86 executes digital-to-analog conversion of the selected video signal using the selected clock signal. A video control signal generator 80 supplies read-permit signals HPIE1-3 and VPIE1-3 to the three memory control units 71–73 to alternate the video signals suppled to the display device. This results in displaying video images read out of the three video memory units 61–63 to be overlapped one upon another on the display screen.

17 Claims, 36 Drawing Sheets

Wv = 1200 LINES
Wh = 1600 PIXELS
Nb = 2 BITS

Wv = 1200 LINES
Wh = 1600 PIXELS
Nb = 24 BITS

Wv = 400 LINES
Wh = 640 PIXELS
Nb = 24 BITS

Wv = 600 LINES
Wh = 800 PIXELS
Nb = 24 BITS

Fig. 6 (a) H1
Fig. 6 (b) H2
Fig. 6 (c) H3
Fig. 6 (d) H4
Fig. 6 (e) H5
Fig. 6 (f) DTCLK
Fig. 6 (g) HSYNC
Fig. 6 (h) HYENB
Fig. 6 (i) H6
Fig. 6 (j) H7
Fig. 6 (k) HPIE

V SYNCHRONIZATION PERIOD
V BACK PORCH PERIOD
V VIDEO EFFECTIVE PERIOD
V FRONT PORCH PERIOD
V RESET PERIOD
V DISPLAY START TIME
V DISPLAY TIME
Fig. 7(a) V1
Fig. 7(b) V2
Fig. 7(c) V3
Fig. 7(d) V4
Fig. 7(e) V5
Fig. 7(f) HSYNC
Fig. 7(g) VSYNC
Fig. 7(h) VYENB
Fig. 7(i) V6
Fig. 7(j) V7
Fig. 7(k) VPIE

Fig. 9(a) VPIE
Fig. 9(b) /VCLK
Fig. 9(c) HPIE
Fig. 9(d) VCLR
Fig. 9(e) INC
Fig. 9(f) HCLR
Fig. 9(g) RE
Fig. 9(h) CLK

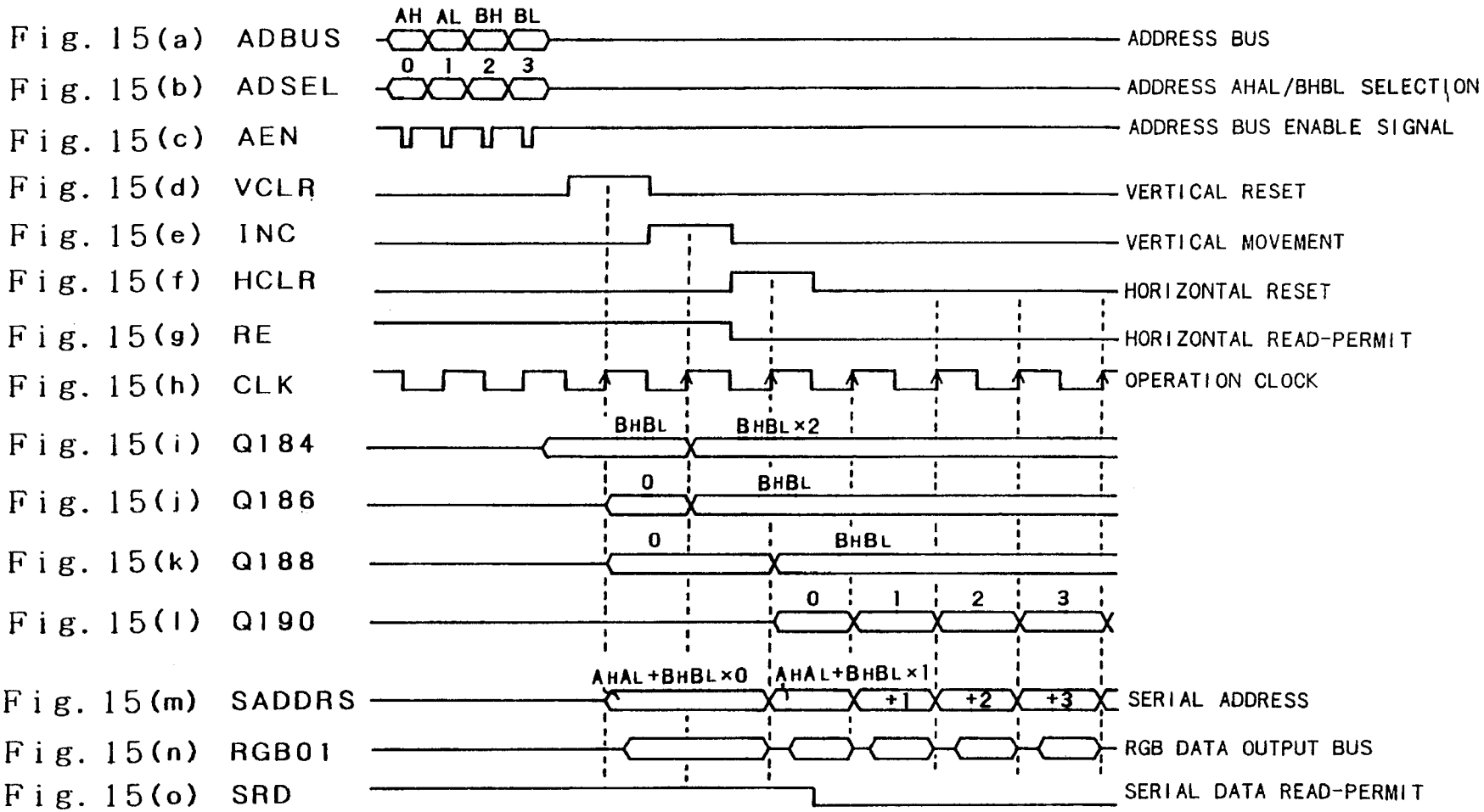
Fig. 15(a) ADBUS
Fig. 15(b) ADSEL
Fig. 15(c) AEN
Fig. 15(d) VCLR
Fig. 15(e) INC
Fig. 15(f) HCLR
Fig. 15(g) RE
Fig. 15(h) CLK
Fig. 15(i) Q184
Fig. 15(j) Q186
Fig. 15(k) Q188
Fig. 15(l) Q190
Fig. 15(m) SADDRS
Fig. 15(n) RGB01
Fig. 15(o) SRD
AH AL BH BL
0 1 2 3
ADDRESS BUS
ADDRESS AHAL/BHBL SELECTION
ADDRESS BUS ENABLE SIGNAL
VERTICAL RESET
VERTICAL MOVEMENT
HORIZONTAL RESET
HORIZONTAL READ-PERMIT
OPERATION CLOCK
BHBL
BHBL×2
0
BHBL
0
BHBL
0 1 2 3
AHAL+BHBL×0
AHAL+BHBL×1
+1 +2 +3
SERIAL ADDRESS
RGB DATA OUTPUT BUS
SERIAL DATA READ-PERMIT

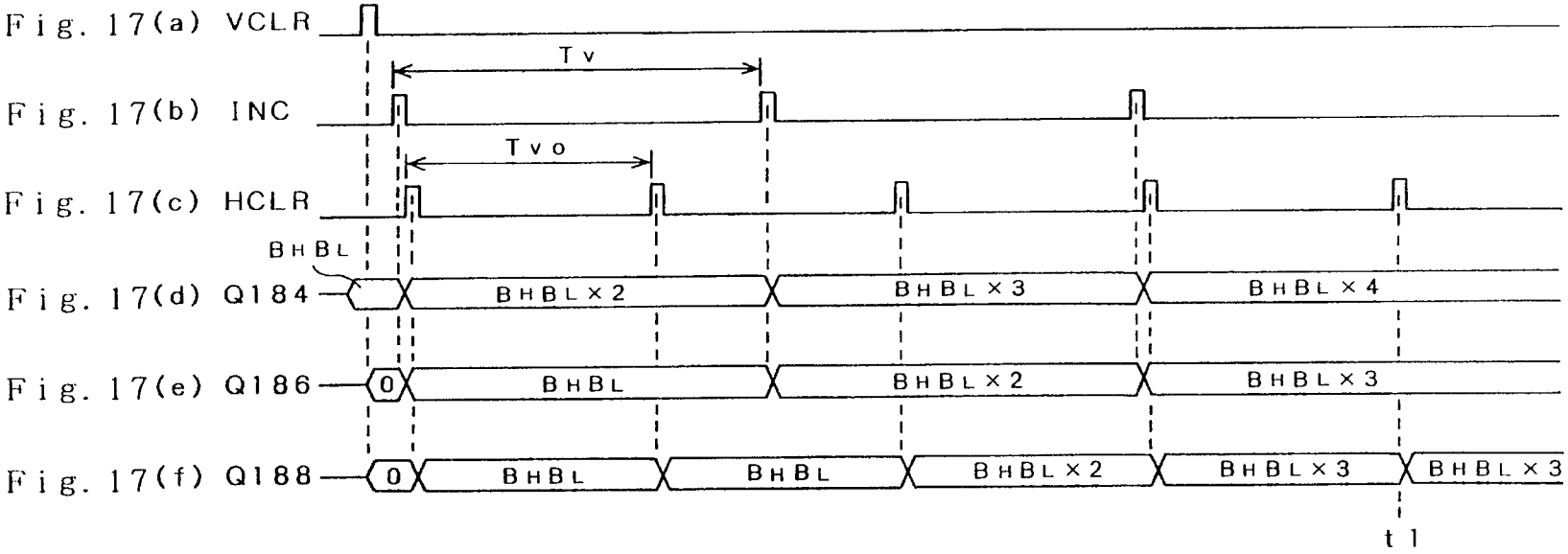
Fig. 17(a) VCLR
Fig. 17(b) INC
Fig. 17(c) HCLR
Fig. 17(d) Q184
Fig. 17(e) Q186
Fig. 17(f) Q188
Tv
Tvo
BHBL
BHBL×2
BHBL×3
BHBL×4
BHBL
BHBL×2
BHBL×3
BHBL
BHBL
BHBL×2
BHBL×3
0
0
t1

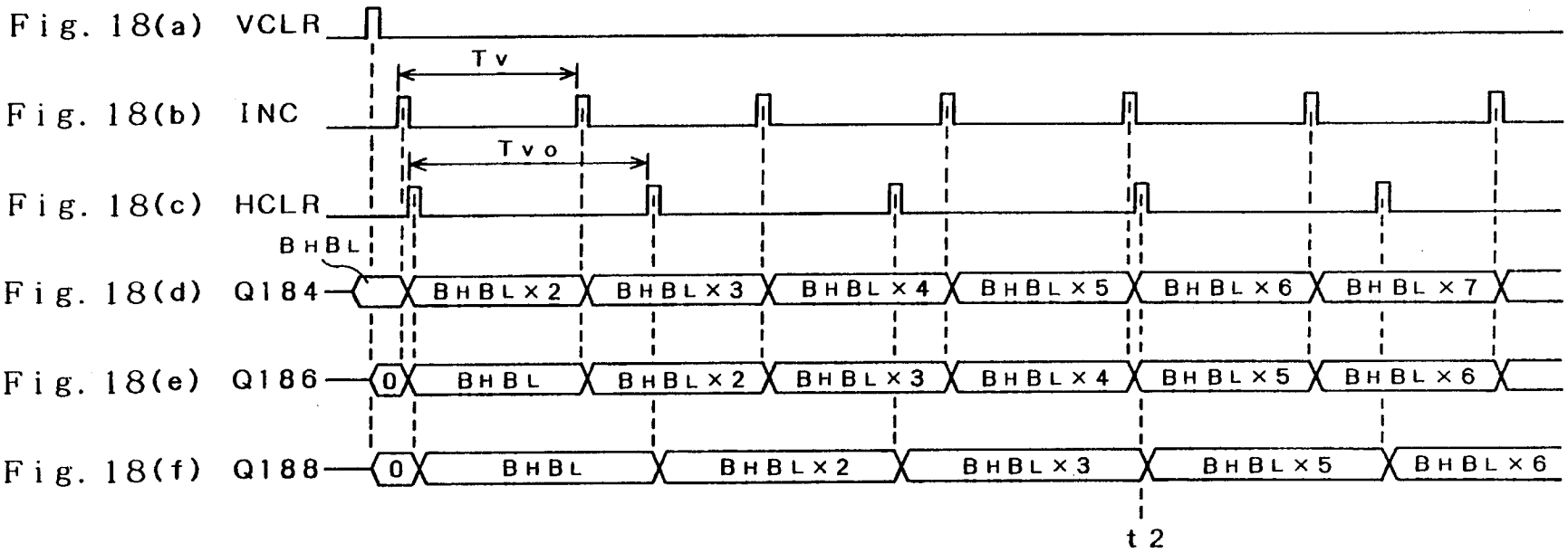
Fig. 18(a) VCLR
Fig. 18(b) INC
Fig. 18(c) HCLR
Fig. 18(d) Q184
Fig. 18(e) Q186
Fig. 18(f) Q188
Tv
Tvo
BHBL
BHBL×2
BHBL×3
BHBL×4
BHBL×5
BHBL×6
BHBL×7
BHBL
BHBL×2
BHBL×3
BHBL×4
BHBL×5
BHBL×6
0
BHBL
BHBL×2
BHBL×3
BHBL×5
BHBL×6
t2

Fig. 19(B)

| | SETTINGS | FIRST VIDEO DISPLAY AREA W01 | SECOND VIDEO DISPLAY AREA W02 |
|---|---|---|---|
| MEMORY CONTROL UNITS 71, 72 (FIGS. 1 AND 8) | PRESET VALUE Nh OF H-PLL UNIT 141 | Nh0 *1 | |
| | FREQUENCY fh OF CLOCK SIGNAL CLKi | fh0=100MHz | |
| | PRESET VALUE Nv OF V-PLL UNIT 142 | Nv0 *2 | |
| | FREQUENCY fv OF VERTICAL INCREMENT SIGNAL INCi | fv0=80kHz | |
| PERMIT SIGNAL GENERATOR CIRCUITS 131 AND 132 (FIG. 5) | PRESET VALUE Kh1 ON HORIZONTAL DISPLAY START TIME COUNTER 134 | 0 | |
| | PRESET VALUE Kh2 ON HORIZONTAL DISPLAY TIME COUNTER 135 | 1600 | |
| | PRESET VALUE Kv1 ON VERTICAL DISPLAY START TIME COUNTER 137 | 0 | |
| | PRESET VALUE Kv2 ON VERTICAL DISPLAY TIME COUNTER 138 | 1200 | |

*1)
Nh0=1600+HS+HB+HF+HR

*2)
Nv0=1200+VS+VB+VF+VR

Fig. 20(B)

| | SETTINGS | FIRST VIDEO DISPLAY AREA W01 | SECOND VIDEO DISPLAY AREA W02 |
|---|---|---|---|
| MEMORY CONTROL UNITS 71, 72 (FIGS. 1 AND 8) | PRESET VALUE Nh OF H-PLL UNIT 141 | Nh0 *1 | $INT\left(Nh0 \times \frac{640}{640}\right)$ |
| | FREQUENCY fh OF CLOCK SIGNAL CLKi | fh0=100MHz | $fh0 \times \frac{640}{640}$ |
| | PRESET VALUE Nv OF V-PLL UNIT 142 | Nv0 *2 | $INT\left(Nv0 \times \frac{400}{400}\right)$ |
| | FREQUENCY fv OF VERTICAL INCREMENT SIGNAL INCi | fv0=80kHz | $fv0 \times \frac{400}{400}$ |
| PERMIT SIGNAL GENERATOR CIRCUITS 131 AND 132 (FIG. 5) | PRESET VALUE Kh1 ON HORIZONTAL DISPLAY START TIME COUNTER 134 | 0 | ΔHsi |
| | PRESET VALUE Kh2 ON HORIZONTAL DISPLAY TIME COUNTER 135 | 1600 | 640 |
| | PRESET VALUE Kv1 ON VERTICAL DISPLAY START TIME COUNTER 137 | 0 | ΔVsi |
| | PRESET VALUE Kv2 ON VERTICAL DISPLAY TIME COUNTER 138 | 1200 | 400 |

*1)
Nh0=1600+HS+HB+HF+HR

*2)
Nv0=1200+VS+VB+VF+VR

Fig. 21(B)

| | SETTINGS | FIRST VIDEO DISPLAY AREA W01 | SECOND VIDEO DISPLAY AREA W02 |
|---|---|---|---|
| MEMORY CONTROL UNITS 71, 72 (FIGS. 1 AND 8) | PRESET VALUE Nh OF H-PLL UNIT 141 | Nh0 *1 | $INT\left(Nh0 \times \frac{640}{640}\right)$ |
| | FREQUENCY fh OF CLOCK SIGNAL CLKi | fh0=100MHz | $fh0 \times \frac{640}{640}$ |
| | PRESET VALUE Nv OF V-PLL UNIT 142 | Nv0 *2 | $INT\left(Nv0 \times \frac{400}{400}\right)$ |
| | FREQUENCY fv OF VERTICAL INCREMENT SIGNAL INCi | fv0=80kHz | $fv0 \times \frac{400}{400}$ |
| PERMIT SIGNAL GENERATOR CIRCUITS 131 AND 132 (FIG. 5) | PRESET VALUE Kh1 ON HORIZONTAL DISPLAY START TIME COUNTER 134 | 0 | ΔHst |
| | PRESET VALUE Kh2 ON HORIZONTAL DISPLAY TIME COUNTER 135 | 1600 | 512 |
| | PRESET VALUE Kv1 ON VERTICAL DISPLAY START TIME COUNTER 137 | 0 | ΔVst |
| | PRESET VALUE Kv2 ON VERTICAL DISPLAY TIME COUNTER 138 | 1200 | 320 |

*1)
Nh0=1600+HS+HB+HF+HR

*2)
Nv0=1200+VS+VB+VF+VR

Fig. 22(B)

| | SETTINGS | FIRST VIDEO DISPLAY AREA W01 | SECOND VIDEO DISPLAY AREA W02 |
|---|---|---|---|
| MEMORY CONTROL UNITS 71, 72 (FIGS. 1 AND 8) | PRESET VALUE Nh OF H-PLL UNIT 141 | Nh0 *1 | $INT\left(Nh0 \times \frac{640}{960}\right)$ |
| | FREQUENCY fh OF CLOCK SIGNAL CLKi | fh0=100MHz | $fh0 \times \frac{640}{960}$ |
| | PRESET VALUE Nv OF V-PLL UNIT 142 | Nv0 *2 | $INT\left(Nv0 \times \frac{400}{400}\right)$ |
| | FREQUENCY fv OF VERTICAL INCREMENT SIGNAL INCi | fv0=80kHz | $fv0 \times \frac{400}{400}$ |
| PERMIT SIGNAL GENERATOR CIRCUITS 131 AND 132 (FIG. 5) | PRESET VALUE Kh1 ON HORIZONTAL DISPLAY START TIME COUNTER 134 | 0 | ΔHsr |
| | PRESET VALUE Kh2 ON HORIZONTAL DISPLAY TIME COUNTER 135 | 1600 | 960 |
| | PRESET VALUE Kv1 ON VERTICAL DISPLAY START TIME COUNTER 137 | 0 | ΔVsr |
| | PRESET VALUE Kv2 ON VERTICAL DISPLAY TIME COUNTER 138 | 1200 | 400 |

*1)
Nh0=1600+HS+HB+HF+HR

*2)
Nv0=1200+VS+VB+VF+VR

Fig. 23(B)

| | SETTINGS | FIRST VIDEO DISPLAY AREA W01 | SECOND VIDEO DISPLAY AREA W02 |
|---|---|---|---|
| MEMORY CONTROL UNITS 71, 72 (FIGS. 1 AND 8) | PRESET VALUE Nh OF H-PLL UNIT 141 | Nh0 *1 | $INT\left(Nh0 \times \frac{640}{640}\right)$ |
| | FREQUENCY fh OF CLOCK SIGNAL CLKi | fh0=100MHz | $fh0 \times \frac{640}{640}$ |
| | PRESET VALUE Nv OF V-PLL UNIT 142 | Nv0 *2 | $INT\left(Nv0 \times \frac{400}{600}\right)$ |
| | FREQUENCY fv OF VERTICAL INCREMENT SIGNAL INCi | fv0=80kHz | $fv0 \times \frac{400}{600}$ |
| PERMIT SIGNAL GENERATOR CIRCUITS 131 AND 132 (FIG. 5) | PRESET VALUE Kh1 ON HORIZONTAL DISPLAY START TIME COUNTER 134 | 0 | ΔHs1 |
| | PRESET VALUE Kh2 ON HORIZONTAL DISPLAY TIME COUNTER 135 | 1600 | 640 |
| | PRESET VALUE Kv1 ON VERTICAL DISPLAY START TIME COUNTER 137 | 0 | ΔVs1 |
| | PRESET VALUE Kv2 ON VERTICAL DISPLAY TIME COUNTER 138 | 1200 | 600 |

*1)
Nh0=1600+HS+HB+HF+HR

*2)
Nv0=1200+VS+VB+VF+VR

Fig. 24(B)

| | SETTINGS | FIRST VIDEO DISPLAY AREA W01 | SECOND VIDEO DISPLAY AREA W02 |
|---|---|---|---|
| MEMORY CONTROL UNITS 71, 72 (FIGS. 1 AND 8) | PRESET VALUE Nh OF H-PLL UNIT 141 | Nh0 *1 | $INT\left(Nh0 \times \frac{640}{640}\right)$ |
| | FREQUENCY fh OF CLOCK SIGNAL CLKi | fh0=100MHz | $fh0 \times \frac{640}{640}$ |
| | PRESET VALUE Nv OF V-PLL UNIT 142 | Nv0 *2 | $INT\left(Nv0 \times \frac{400}{286}\right)$ |
| | FREQUENCY fv OF VERTICAL INCREMENT SIGNAL INCi | fv0=80kHz | $fv0 \times \frac{400}{286}$ |
| PERMIT SIGNAL GENERATOR CIRCUITS 131 AND 132 (FIG. 5) | PRESET VALUE Kh1 ON HORIZONTAL DISPLAY START TIME COUNTER 134 | 0 | $\Delta H_{ST}$ |
| | PRESET VALUE Kh2 ON HORIZONTAL DISPLAY TIME COUNTER 135 | 1600 | 640 |
| | PRESET VALUE Kv1 ON VERTICAL DISPLAY START TIME COUNTER 137 | 0 | $\Delta V_{ST}$ |
| | PRESET VALUE Kv2 ON VERTICAL DISPLAY TIME COUNTER 138 | 1200 | 286 |

*1)
Nh0=1600+HS+HB+HF+HR

*2)
Nv0=1200+VS+VB+VF+VR

CONTROL CLOCK SELECTOR 250

| WEO | 1 | 0 |
|---|---|---|
| CLKO | DRCLK | DDCLK |

DH SYNCHRONIZATION PERIOD
DH BACK PORCH PERIOD
DH VIDEO EFFECTIVE PERIOD
DH FRONT PORCH PERIOD
DH DISPLAY START TIME
DH DISPLAY TIME
Fig. 26(a) DHSYNC
Fig. 26(b) DH1
Fig. 26(c) DH2
Fig. 26(d) DHYENB
Fig. 26(e) DH3
Fig. 26(f) DH4
Fig. 26(g) DHWE
Fig. 26(h) HCLWO

DV SYNCHRONIZATION PERIOD
DV BACK PORCH PERIOD
DV VIDEO EFFECTIVE PERIOD
DV FRONT PORCH PERIOD
DV DISPLAY START TIME
DV DISPLAY TIME
Fig. 27(a) DVSYNC
Fig. 27(b) DV1
Fig. 27(c) DV2
Fig. 27(d) DVYENB
Fig. 27(e) DV3
Fig. 27(f) DV4
Fig. 27(g) DVWE
Fig. 27(h) VCLW0
Fig. 27(i) INC0

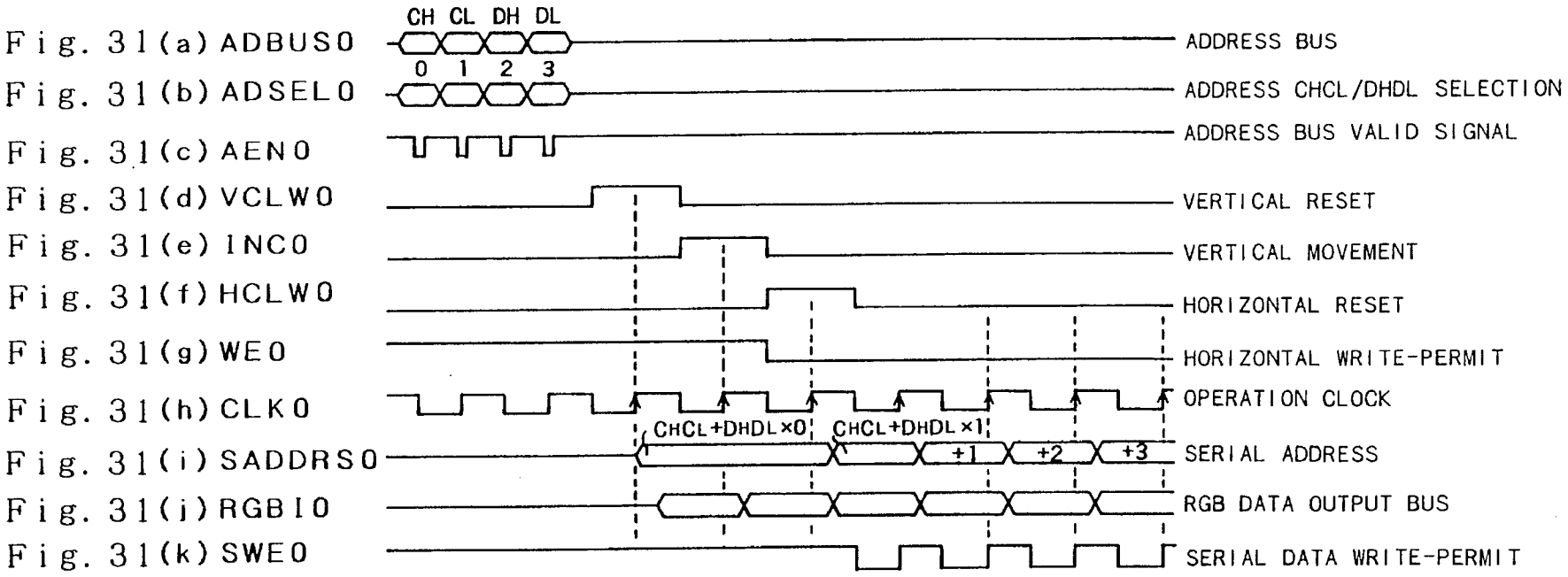
Fig. 31(a) ADBUS0
Fig. 31(b) ADSEL0
Fig. 31(c) AEN0
Fig. 31(d) VCLW0
Fig. 31(e) INC0
Fig. 31(f) HCLW0
Fig. 31(g) WE0
Fig. 31(h) CLK0
Fig. 31(i) SADDRS0
Fig. 31(j) RGBI0
Fig. 31(k) SWE0
CH CL DH DL
0 1 2 3
ADDRESS BUS
ADDRESS CHCL/DHDL SELECTION
ADDRESS BUS VALID SIGNAL
VERTICAL RESET
VERTICAL MOVEMENT
HORIZONTAL RESET
HORIZONTAL WRITE-PERMIT
OPERATION CLOCK
SERIAL ADDRESS
RGB DATA OUTPUT BUS
SERIAL DATA WRITE-PERMIT
CHCL+DHDL×0
CHCL+DHDL×1
+1
+2
+3

Fig. 34(A)
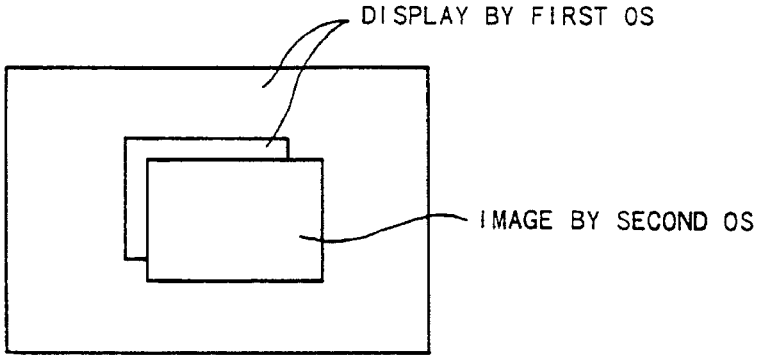
Fig. 34(B)
Fig. 34(C)
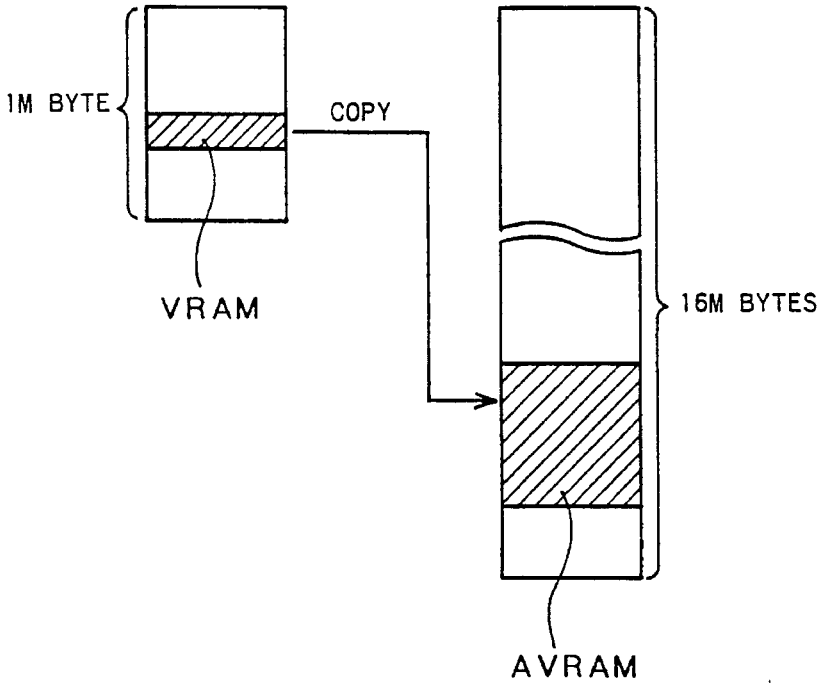

METHOD AND APPARATUS FOR DISPLAYING VIDEO IMAGE

BACKGROUND OF THE INVENTION

1. Field of the Invention

The present invention relates to a method of and an apparatus for simultaneously displaying a plurality of video images on a display screen based on video signals stored in a plurality of video memories.

2. Description of the Related Art

FIGS. 34(A) through 34(C) show operation of a conventional video display apparatus of a personal computer system. Some recent personal computers can be operated by a plurality of operating systems (OS). FIG. 34(A) shows a display screen operated by a first OS, or MS-WINDOWS (trademark of Microsoft Corp.), where an image generated by a second OS, or MS-DOS (trademark of Microsoft Corp.) is displayed in a window of the first OS. FIGS. 34(B) and 34(C) show address spaces of these two operating systems.

In order to display an image generated by the second OS within a window of the first OS in the conventional system, video data should be transferred from a video memory (VRAM) of the second OS to another video memory (A-VRAM) of the first OS as indicated by the arrow in FIGS. 34(B) and 34(C). Since the transfer of the video data is executed by a CPU, it requires quite a long time and causes undesirable delay to the other processing by the CPU. Such problems often arise when a plurality of video memories are used in the video display apparatus.

SUMMARY OF THE INVENTION

An object of the present invention is thus to simultaneously display a plurality of video images on a display screen according to video data stored in a plurality of video memories without transferring the video data among the video memories.

The above object is at least partly attained by a video display apparatus, for use in a computer system, for simultaneously displaying a plurality of video images on a display screen, comprising: a plurality of video memories for storing a plurality of video signals, respectively; video control signal generation means for generating a plurality of read-permit signals indicating timings of reading of the plurality of video signals from the plurality of video memory, respectively; memory control means for generating a plurality of read control signals from the plurality of read-permit signals, supplying the plurality of read control signals to the plurality of video memories to allow the plurality of video signals to be read out of the plurality of video memories, and generating a plurality of clock signals which are respectively synchronous with the plurality of video signals read out of the plurality of video memories; selection signal generating means for generating a video selection signal which indicates to change selection of the plurality of video signals at a plurality of positions on the display screen; selection means for selecting one of the plurality of video signals and one of the plurality of clock signals in response to the video selection signal; and display means having the display screen for displaying a video image as a function of the video signal and the clock signal selected by the selection means.

The selection means selects one of the plurality of video signals and also selects one of the plurality of clock signals corresponding to the selected video signal. This allows a plurality of video images to be displayed simultaneously and on the display screen according to video data stored in the plurality of video memories without transferring the video data among the video memories.

Preferably, the selection signal generating means comprises: a memory, having a memory area corresponding to a specific area including a plurality of pixels on the display screen, for storing video selection data which indicates to select one of the plurality of video signals for each of the plurality of pixels; and control signal supply means for supplying a selection-data read control signal to the memory to read out the video selection data from the memory as the video selection signal.

In a preferred embodiment of the present invention, the control signal supply means comprises a transmission path for transmitting one of the plurality of read control signals to the memory as the selection-data read control signal.

The display means comprises a digital-to-analog converter for converting a digital video signal selected by the selection means to an analog video signal in response to the clock signal selected by the selection means.

According to an aspect of the present invention, the plurality of video memories comprises a first video memory; and the video control signal generation means comprises means for generating a first signal having a first period which corresponds to a scanning time for one scanning line on the display screen of the display means. The memory control means comprises: a first PLL circuit for generating from the first signal a first clock signal having a period which is N1 times the first period of the first signal, where N1 is an integer; horizontal address generation means for generating a horizontal address for the first video memory, the horizontal address generation means comprising horizontal address update means for increasing the horizontal address in response to each pulse of the first clock signal; vertical address generation means for generating a vertical address for the first video memory; and address combining means for combining the vertical address and the horizontal address to produce an address to be supplied to the first video memory.

In a preferred embodiment, the video display apparatus further comprises: a processor for executing arithmetic and logical operations; and a bus for connecting the processor with the plurality of video memories and connecting the processor with the memory control means; and wherein the processor comprises means for changing a value of the integer N1 in the first PLL circuit to scale a first video image in a horizontal direction, the first video image being represented by a first video signal read out of the first video memory.

The video control signal generation means comprises means for generating a second signal having a second period which corresponds to a scanning time for one display screen of the display means. The memory control means further comprises: means for generating from the first signal supplied from the video control signal generation means a first scanning-line update signal indicating a timing which corresponds to an end of one scanning line for the first video signal read out of the first video memory; and a second PLL circuit for generating from one of the first and second signals a second scanning-line update signal having a period which is N2 times the second period of the second signal, where N2 is an integer. The horizontal address generation means comprises means for resetting the horizontal address to a predetermined initial value in response to each pulse of the first scanning-line update signal. The vertical address generation means comprises vertical address update means for updating the vertical address by adding an address increase to the vertical address in response to each pulse of the first scanning-line update signal, the address increase being a product of an address difference corresponding to a predetermined number of scanning lines on the display screen and the number of pulses of the second scanning-line update signal which are occurred between latest two pulses of the first scanning-line update signal.

The processor comprises means for changing a value of the integer N2 in the second PLL circuit to scale the first video image in a vertical direction.

The present invention is also directed to a computer system comprising the video display apparatus.

The present invention is further directed to a method for simultaneously displaying a plurality of video images on a display screen. The method comprises the steps of: providing a plurality of video signals stored in a plurality of video memories, respectively; generating a plurality of read-permit signals indicating timings of reading of the plurality of video signals from the plurality of video memory, respectively; generating a plurality of read control signals from the plurality of read-permit signals, supplying the plurality of read control signals to the plurality of video memories to allow the plurality of video signals to be read out of the plurality of video memories, and generating a plurality of clock signals which are respectively synchronous with the plurality of video signals read out of the plurality of video memories; generating a video selection signal which indicates to change selection of the plurality of video signals at a plurality of positions on the display screen; selecting one of the plurality of video signals and one of the plurality of clock signals in response to the video selection signal; and displaying a video image as a function of the selected video signal and the selected clock signal.

These and other objects, features, aspects, and advantages of the present invention will become more apparent from the following detailed description of the preferred embodiment with the accompanying drawings.

BRIEF DESCRIPTION OF THE DRAWINGS

FIGS. 15(*a*) through (*o*) are timing charts showing the operation of the serial read control unit 161;

FIGS. 17(*a*) through 17(*f*) are timing charts showing the operation of the serial read control unit 161 in vertical image expansion;

FIGS. 18(*a*) through 18(*f*) are timing charts showing the operation of the serial read control unit 161 in vertical image compression;

FIGS. 19(A) and 19(B) show various settings of the memory control units and the permit signal generator circuits when only a first video image is displayed;

FIGS. 20(A) and 20(B) show various settings of the memory control units and the permit signal generator circuits when a second video image is not scaled and displayed totally;

FIGS. 21(A) and 21(B) show various settings of the memory control units and the permit signal generator circuits when the second video image is not scaled and displayed only partly;

FIGS. 22(A) and 22(B) show various settings of the memory control units and the permit signal generator circuits when the second video image is horizontally expanded and displayed totally;

FIGS. 23(A) and 23(B) show various settings of the memory control units and the permit signal generator circuits when the second video image is vertically expanded and displayed totally;

FIGS. 24(A) and 24(B) show various settings of the memory control units and the permit signal generator circuits when the second video image is vertically compressed and displayed totally;

FIGS. 31(*a*) through 31(*k*) are timing charts showing the operation of the serial write control unit 260;

FIGS. 34(A) through 34(C) show the operation of a conventional video display apparatus.

DESCRIPTION OF THE PREFERRED EMBODIMENT

Figure 1:
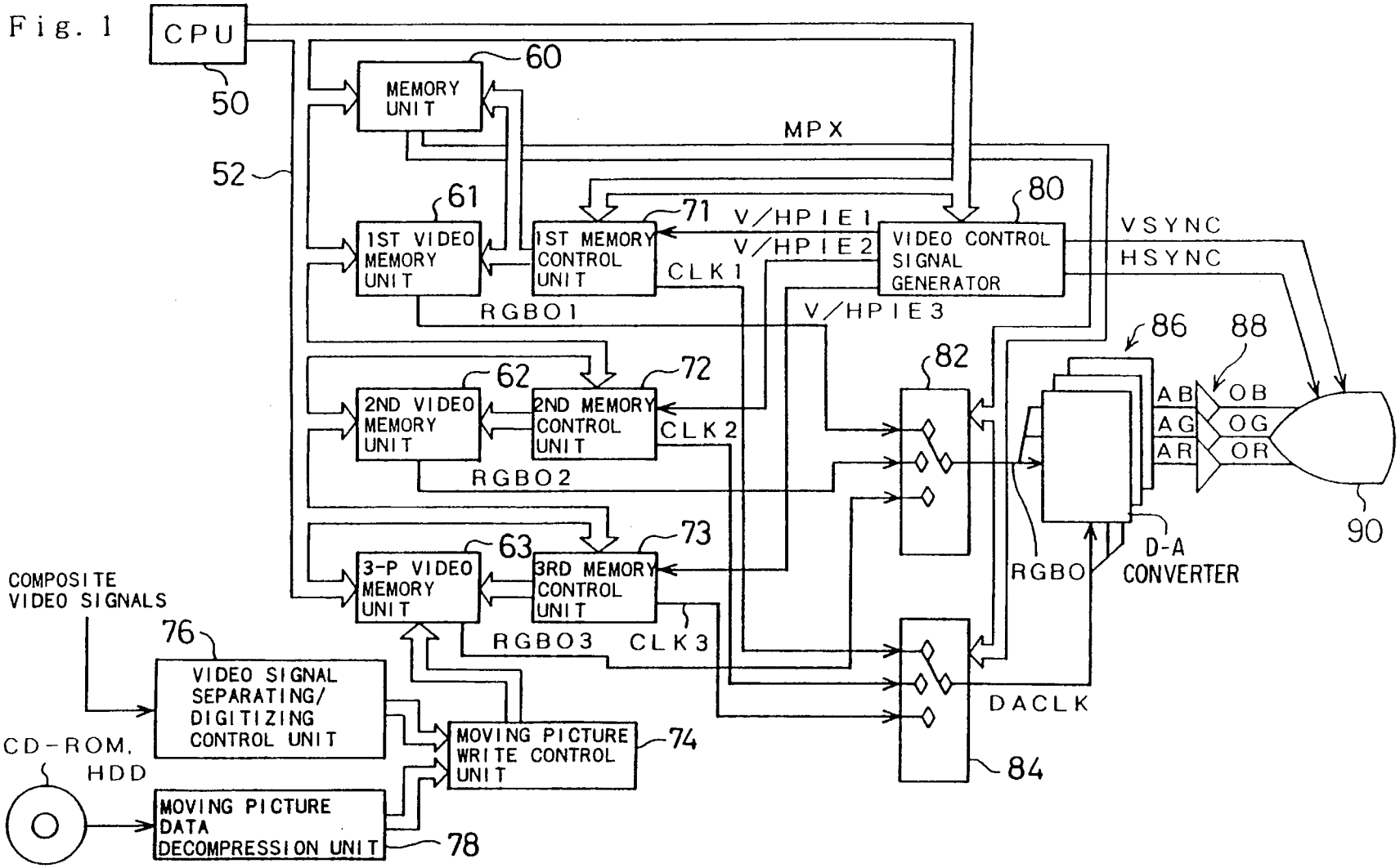
FIG. 1 is a block diagram illustrating a general structure of a computer system having a video display apparatus embodying the invention.

The preferred embodiment of the present invention will be described in the following order:

A. Structure and Operation of Apparatus
B. Video Control Signal Generator
C. Memory Control Unit and Video Memory Unit
D. Various Settings in Video Image Scaling
E. Moving Picture Write Control Unit
F. 3-Port Video Memory Unit
G. Modifications A. Structure and Operation of Apparatus FIG. 1 is a block diagram illustrating the structure of a computer system having a video display apparatus embodying the present invention. A CPU 50 is connected with a memory unit 60, first and second video memory units 61 and 62 and a 3-port video memory unit 63 via a CPU bus 52. The three video memory units 61, 62, and 63 receive control signals output from first through third memory control units 71, 72, and 73, respectively. Video signals are serially read out of the video memory units 61, 62, and 63 according to the control signals. The first memory control unit 71 provides the control signal to the memory unit 60 as well as to the first video memory unit 61. The memory unit 60 stores a multiplexing signal MPX which is used to select one of the video signals read out of the three video memory units 61 through 63. Structures and functions of the four memory units 60 through 63 will be described later in detail.

The 3-port video memory unit 63 has a read port connected to the third memory control unit 73, a first write port connected with the CPU bus 52, and a second write port connected to a moving picture write control unit 74. The moving picture write-control unit 74 receives video data of moving pictures supplied from a video signal separating/digitizing control unit 76 and a moving picture data decompression unit 78. The video signal separating/digitizing control unit 76 divides a composite video signal, which is supplied from a TV tuner or a video player, into synchronizing signals and component video signals (RGB signals or YUV signals), and converts the component video signals to digital video signals, and supplies the digital video signals to the moving picture write-control unit 74. The moving picture data decompression unit 78 decompresses compressed video data stored in a CD-ROM, a hard disk, or a magneto-optical disk, and transmits the decompressed video data to the moving picture write-control unit 74. The moving picture write-control unit 74 writes the supplied video data of moving pictures into the 3-port video memory unit 63. An internal structure and operation of the moving picture write-control unit 74 will be described in detail later.

The computer system is further provided with a video control signal generator 80, a video signal switching unit 82, a clock signal switching unit 84, three digital-to-analog converters (D-A converter) 86, three amplifiers 88, and a color monitor 90. The video control signal generator 80 generates and supplies vertical read-permit signals VPIE1, VPIE2, and VPIE3, and horizontal read-permit signals HPIE1, HPIE2, and HPIE3 to the three memory control units 71 through 73 to instruct read-out timings of video signals. The video signal switching unit 82 selects one of three video signals RGB01, RGB02, and RGB03 read out of the three video memory units 61 through 63, and supplies the selected video signal to the D-A converters 86. The clock signal switching unit 84 selects one of three clock signals CLK1, CLK2, and CLK3 output from the three memory control units 71 through 73, and supplies the selected clock signal to the D-A converters 86 as a synchronizing signal of digital-to-analog conversion. The video signal switching unit 82 and the clock signal switching unit 84 are supplied with the multiplexing signal MPX from the memory unit 60.

The D-A converters 86 converts the 24-bit digital video signal RGB0, wherein 8 bits are allocated to each color of RGB, to analog videos signals AR, AG, and AB. These analog video signals AR, AG, and AB are amplified by the amplifies 88 and transmitted to the color monitor 90 while the color monitor 90 receives a vertical synchronizing signal VSYNC and a horizontal synchronizing signal HSYNC output from the video control signal generator 80.

Figure 2A:
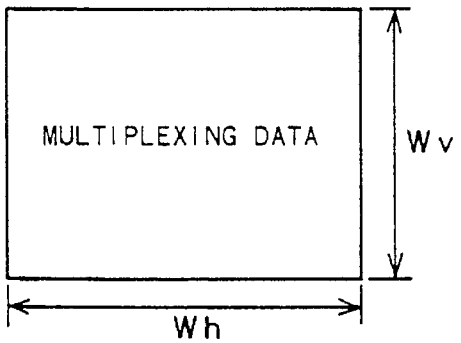
FIGS. 2(A) through 2(D) illustrate memory areas of four video memory units 60 through 63 in terms of dimensions of display screens.

FIGS. 2(A) through 2(D) illustrate memory spaces of the four memory units 60 through 63 in terms of dimensions of display screens. The space of each memory unit is defined by a width or the number of lines Wv in the vertical direction, a height or the number of pixels Wh in the horizontal direction, and a depth or the number of bits Nb allocated to each pixel. As illustrated in FIG. 2(A), the space of the memory unit 60 corresponds to a display screen of 1,600 pixels×1,200 lines and has a depth of 2 bits. Multiplexing data stored in the memory unit 60 are supplied to the video signal switching unit 82 and the clock signal switching unit 84 as the multiplexing signal MPX. The depth of the memory unit 60 is set equal to the number of bits which identifies the maximum number of video memory units to be mounted on the computer system. The embodiment shown in FIG. 1 has three video memory units, and the memory unit 60 accordingly has the depth of 2 bits.

Figure 2B:
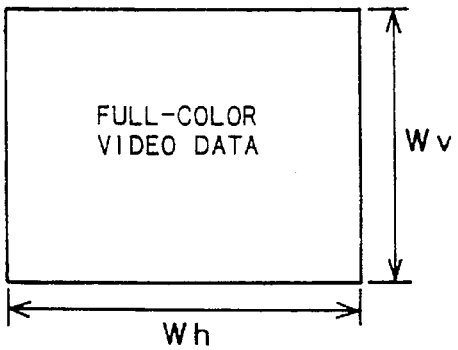

The first video memory unit 61 corresponds to a display screen of 1,600 pixels×1,200 lines and has a depth of 24 bits as illustrated in FIG. 2(B). The first video memory unit 61 stores full-color natural video data. The first video memory unit 61 can be realized by three memories having a depth of 8 bits.

The memory unit 60 and the first video memory unit 61 have identical memory spaces corresponding to the same display screen. The first memory control unit 71 (FIG. 1) supplies the read-out signal commonly to the memory unit 60 and the first video memory unit 61, which respectively output the multiplexing signal MPX and the video signal RGB01 stored at corresponding positions in the respective memory units.

Figure 2C:
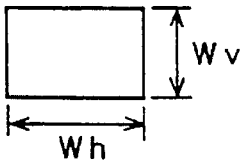
Figure 2D:
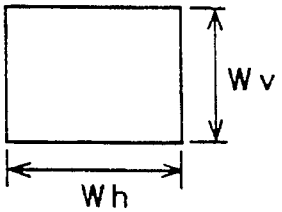

As shown in FIGS. 2(C) and 2(D), the second video memory unit 62 corresponds to a display screen of 640 pixels×400 lines and has a depth of 24 bits, and the 3-port video memory unit 63 corresponds to a screen of 800 pixels×600 lines and has a depth of 24 bits. The three video memory units 61 through 63 may correspond to an identical display screen. The first through the third memory control units 71 through 73 receive the read-permit signals VPIE1-3 and HPIE1-3 supplied from the video control signal generator 80, and read the video signals RGB01-3 out of the video memory units 61 through 63 according to the read-permit signals, respectively.

Figure 3A:
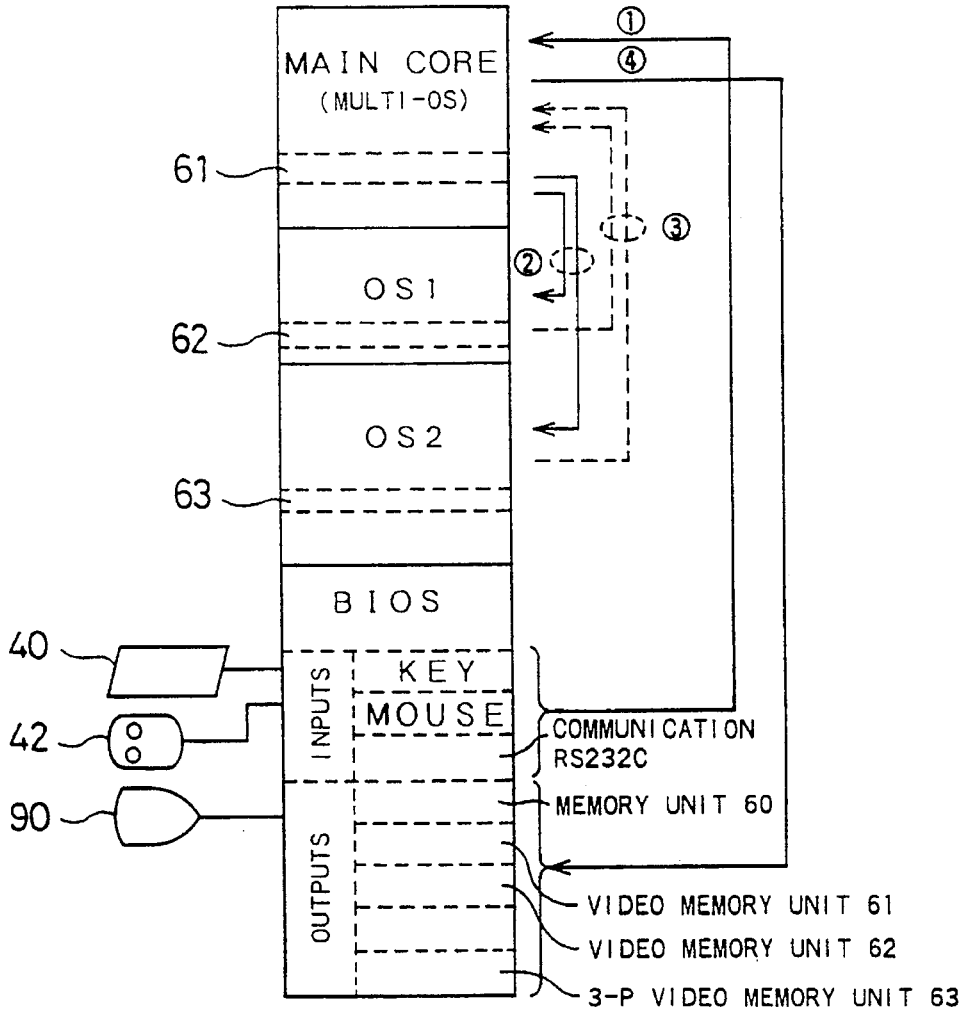
FIGS. 3(A) and 3(B) show an address map of operating systems utilizing the four video memory units.

FIG. 3(A) shows an address map of three operating systems (OS) controlling the three video memory units 61 through 63, respectively. The three video memory units 61 through 63 are respectively managed by different operating systems, that is, multi-OS, OS-1, and OS-2 as shown in FIG. 3(A) The multi-OS has a function of temporarily switching the system control to another OS. Each OS has a memory region corresponding to the respective video memory units 61 through 63. Arrows with numerals 1 through 4 in the drawing of FIG. 3(A) show the procedure of an OS switching process. When a user inputs, through a keyboard 40 or a mouse 42, a certain instruction which requires switching of the system control from the multi-OS to the OS1, a BIOS (basic input/output system) gives a switching instruction to the multi-OS (step 1). The multi-OS gives over the system control to the OS1 in response to the switching instruction (step 2). The OS1 executes a required processing according to the certain instruction, and switches back the system control to the multi-OS upon completion of the processing (step 3). Video images stored in the video memory units 61 through 63 are then displayed on the color monitor 90 via the BIOS (step 4).

Figure 3B:
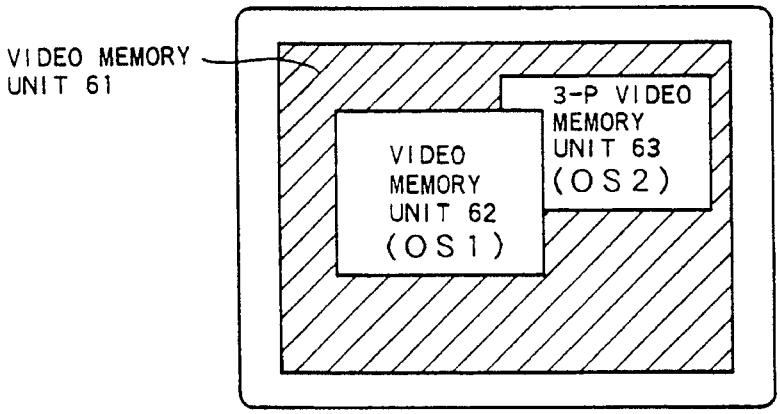

FIG. 3(B) is a plan view illustrating the video images read out of the video memory units 61 through 63 and displayed on the color monitor 90. Although the plural operating systems are used in the embodiment, only one OS may be used to manage a plurality of video memory units. For example, the three video memory units 61 through 63 may be controlled with only one OS.

Figure 4:
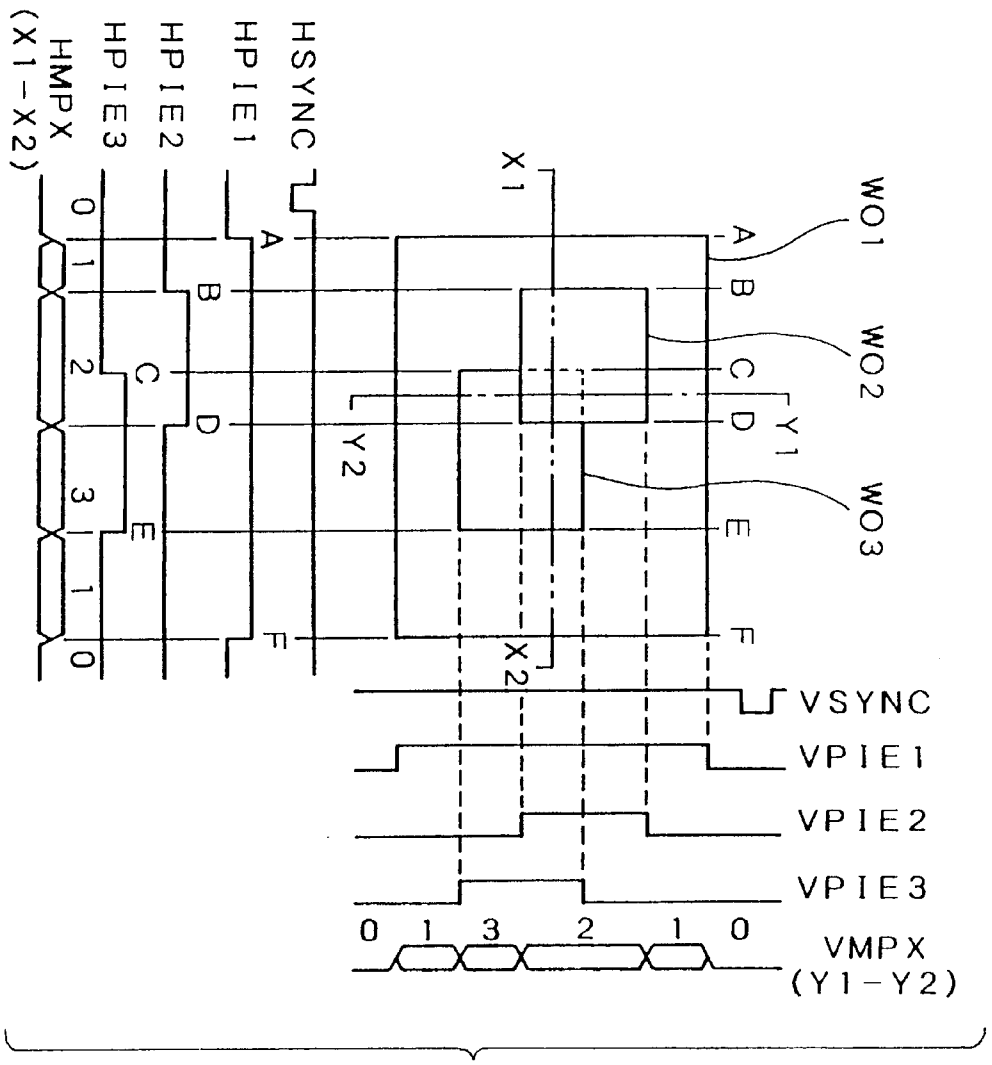
FIG. 4 shows a relation between a screen display on the color monitor 90 with read-permit signals VPIE and HPIE output from the video control signal generator 80.

FIG. 4 shows a relation between a screen display on the color monitor 90 and the read-permit signals VPIE1 through VPIE3 and HPIE1 through HPIE3 output from the video control signal generator 80. Symbols W01, W02, and W03 in FIG. 4 denote three video display areas on the color monitor 90, in which respective images are displayed according to the three video signals RGB01-3 read out of the three video memory units 61 through 63.

Waveforms of signals on an X1–X2 line are shown in the lower portion of FIG. 4: the horizontal synchronizing signal HSYNC, the horizontal read-permit signals HPIE1-3 supplied from the video control signal generator 80 to the three memory control units 71 through 73, and a horizontal component HMPX of the multiplexing signal MPX read out of the memory unit 60. Waveforms of signals on a Y1–Y2 line are shown in the right hand side of FIG. 4: the vertical synchronizing signal VSYNC, the vertical read-permit signals VPIE1-3 supplied from the video control signal generator 80 to the three memory control units 71 through 73, and a vertical component VMPX of the multiplexing signal MPM read out of the memory unit 60.

The horizontal read-permit signal HPIE1 given to the first video memory unit 61 is kept at a high (H) level in a display range between a left-end position A and a right-end position F on the color monitor 90. The vertical read-permit signal VPIE1 is also kept at an H level in the whole vertical range on the screen. The first video signal RGB01 is thus read out of the first video memory unit 61 while both the horizontal and the vertical read-permit signals HPIE1 and VPIE1 are kept at the H level. In the same manner, the second video signal RGB02 is read out of the second video memory unit 62 while both the horizontal and the vertical read-permit signals HPIE2 and VPIE2 are kept at the H level. The third video signal RGB03 is read out of the third video memory unit 63 while both the horizontal and the vertical read-permit signals HPIE3 and VPIE3 are kept at the H level.

The video signal switching unit 82 selects and outputs one of the three video signals RGB01-3 in response to the multiplexing signal MPX supplied from the memory unit 60. Like the first video signal RGB01, the multiplexing signal MPX successively shows values of the multiplexing data for each pixel in each scanning line on the color monitor 90. For the clarity of illustration, however, the variation in the multiplexing signal MPX is shown as a variation in the horizontal component HMPX and that in the vertical component VMPX in FIG. 4. Actually, a series of horizontal components HMPX arranged in the order of scanning constitute the multiplexing signal MPX.

When the horizontal component HMPX of the multiplexing signal MPX varies as 1, 2, 3, 1 on the X1–X2 line as shown in FIG. 4, the video signal switching unit 82 successively selects the video signals RGB01, RGB02, RGB03, and RGB01 accordingly.

The CPU 50 determines the multiplexing data stored in the memory unit 60 according to the size and position of each video display area specified on the screen of the color monitor 90. When the user specifies the dimensions, the positions, and the spatial arrangement of the second and the third video display areas W02 and W03 through keystrokes on the keyboard or clicks of the mouse, the CPU 50 generates multiplexing data based on the specification and writes the multiplexing data into the memory unit 60. A basic video image, such as a background image, is displayed in the first video display area W01 which has a fixed size.

Video images of different sizes as shown in FIGS. 2(B), 2(C), and 2(D) are usually displayed with different synchronizing signals suitable to respective sizes. Therefore it has been difficult for the conventional systems to simultaneously display the video images of different sizes overlapping one another. In the computer system of the embodiment as illustrated in FIG. 1, the first through the third memory control units 71, 72, and 73 output clock signals CLK1, CLK2, and CLK3, which are respectively synchronous with the video signals read out of the video memory units 61 through 63, to the clock signal switching unit 84. The clock signal switching unit 84 then selects one of the clock signals in response to the multiplexing signal MPX read out of the memory unit 60, and supplies the selected clock signal to the D-A converter 86. The D-A converter 86 executes digital-to-analog conversion according to the clock signal synchronous with the video signal output from the video signal switching unit 82. In this manner, the video signals read out of the video memory units 61 through 63 are successively converted to analog video signals AR, AG, and AB in response to the clock signals CLK1, CLK2, and CLK3 respectively synchronous with the video signals. The analog video signals AR, AG, and AB output from the D-A converter 86 can precisely reproduce the video images accordingly.

As described above, the computer system of the embodiment displays video images while the video signal switching unit 82 successively selects one of the video signals RGB01 through RGB03 read out of the three video memory units 61 through 63. The computer system allows high-speed display of a plurality of video images in an overlapping arrangement. The digital-to-analog conversion in response to the clock signals synchronous with the video signals allows a plurality of video images having different sizes to be reproduced precisely.

Since the memory unit 60 and the first video memory unit 61 have the identical memory spaces corresponding to the screen of the color monitor 90, the multiplexing data stored in the memory unit 60 are easily established according to the specification about the dimensions, the positions, and the spatial arrangement of the video display areas W01 through W03 on the color monitor 90.

When each of the three video memory units 61 through 63 is managed by a multi-window system, a plurality of windows can be displayed simultaneously in each of the video display areas W01, W02, and W03.

B. Video Control Signal Generator

Figure 5:
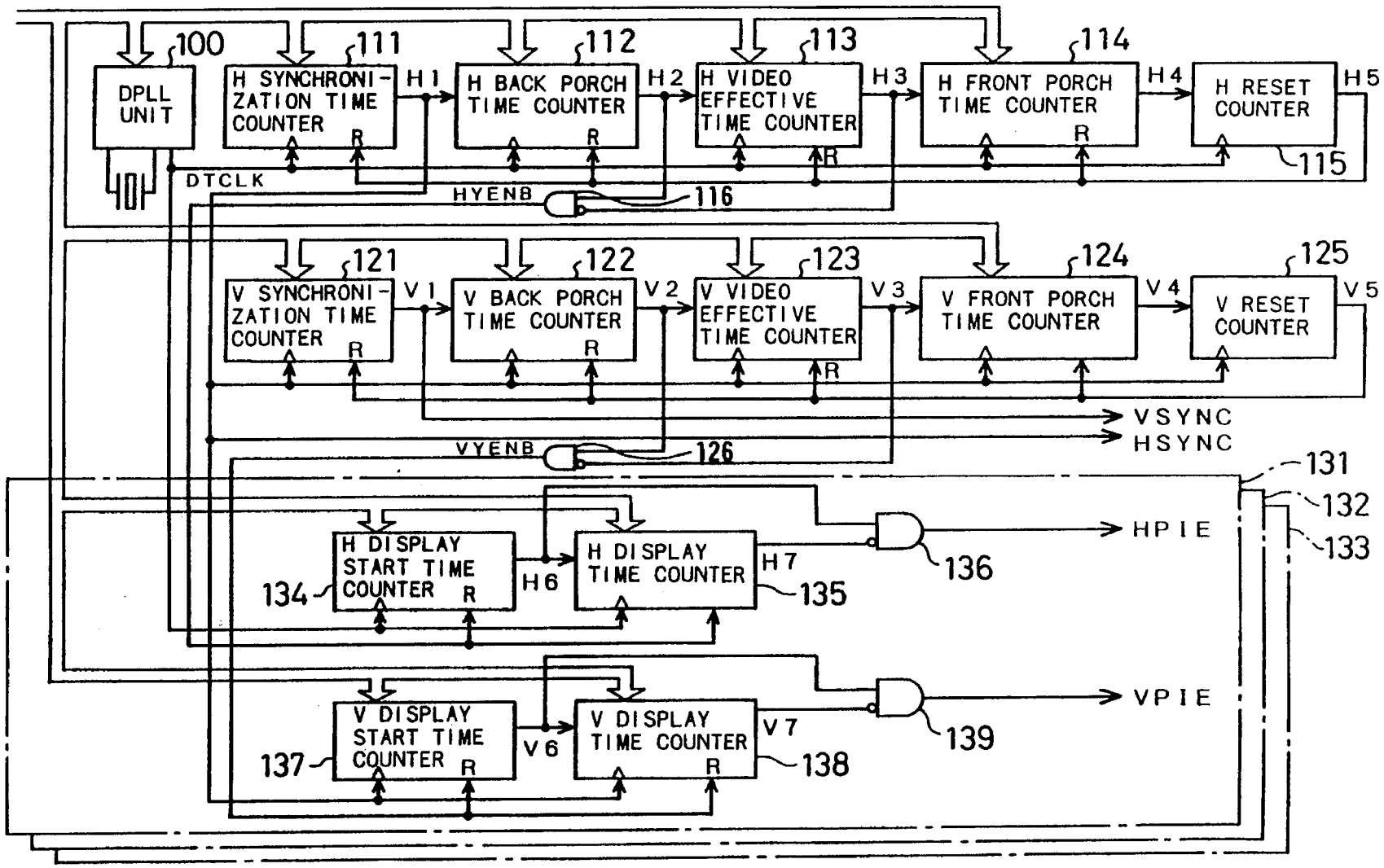
FIG. 5 is a block diagram illustrating the internal structure of the video control signal generator 80.
Figure 6:
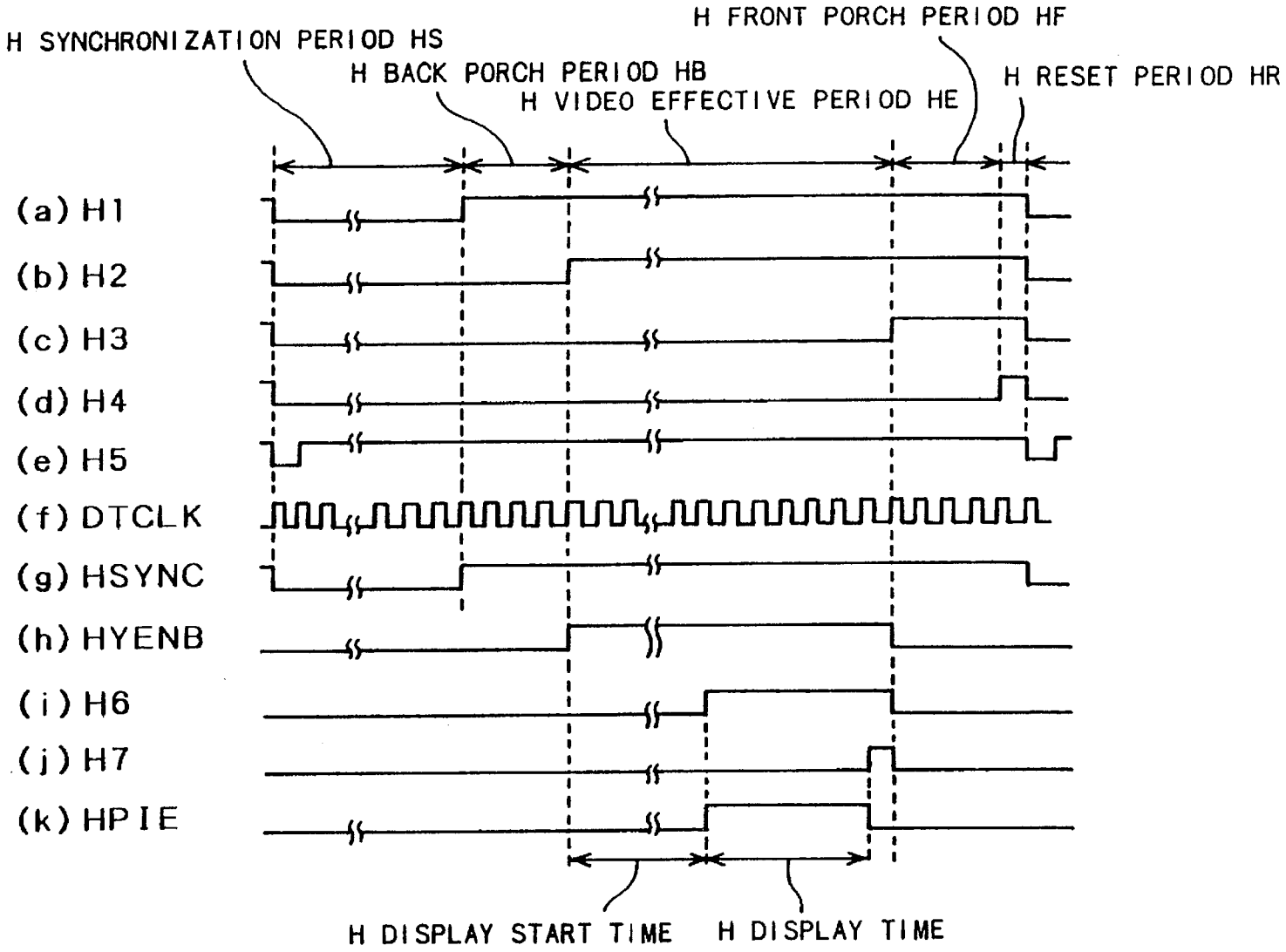
FIGS. 6(*a*) through 6(*k*) are timing charts showing the operation of the video control signal generator 80 in the horizontal direction.

FIG. 5 is a block diagram illustrating the internal structure of the video control signal generator 80. FIGS. 6(*a*) through 6(*k*) are timing charts showing the operation of the video control signal generator 80 in the horizontal direction, and FIGS. 7(*a*) through 7(*k*) shows those in the vertical direction. As illustrated in FIG. 5, the video control signal generator 80 generates the horizontal synchronizing signal HSYNC and the vertical synchronizing signal VSYNC to be supplied to the color monitor 90, and the horizontal read-permit signals HPIE and the vertical read-permit signals VPIE to be supplied to the three memory control units 71 through 73. The video control signal generator 80 includes the following units:

(1) DPLL unit 100: DPLL unit 100 is a PLL circuit for generating a dot clock signal DTCLK used in synchronizing the units within the video control signal generator 80.

(2) Horizontal synchronization time counter 111: Horizontal synchronization time counter 111 generates a signal H1 from the dot clock signal DTCLK, which is at a low (L) level during a horizontal synchronization period HS as shown in FIG. 6(*a*). The horizontal synchronization period HS represents a length of time during which the horizontal synchronizing signal HSYNC is kept at the L level. As illustrated in FIG. 5, the output signal H1 of the counter 111 is directly output outside the video control signal generator 80 as the horizontal synchronizing signal HSYNC. In other words, the counter 111 is a circuit for generating the horizontal synchronizing signal HSYNC. The CPU 50 outputs data representing a duration of the horizontal synchronization period HS in which the signal H1 is at the L level, and writes the data via the CPU bus 52 into a register (not shown) of the horizontal synchronization time counter 111. The duration of the horizontal synchronization period HS is expressed as the number of pulses of the dot clock signal DTCLK. The CPU 50 sets the duration of each time period for all the counters described below. Once the signal H1 rises to an H (high) level, it is kept at the H level until the horizontal synchronization the counter 111 is reset by a reset signal H5 supplied from a horizontal reset time counter 115 (described later).

(3) Horizontal back porch time counter 112: Horizontal back porch time counter 112 generates a signal H2, which falls to an L level in response to the reset signal H5 and rises to an H level at an end of a horizontal back porch period HB (see FIG. 6(*b*)). The horizontal back porch period HB represents a time period between a rise of the horizontal synchronizing signal HSYNC and a start of a horizontal video effective period HE.

(4) Horizontal video effective period counter 113: Horizontal video effective period counter 113 generates a signal H3, which falls to an L level in response to the reset signal H5 and rises to an H level at an end of the horizontal video effective period HE.

As shown in FIG. 5, an AND gate 116 receives the signal H2 and an inversion of the signal H3 to generates an output signal HYENB, which is kept at an H level during the horizontal video effective period HE (see FIG. 6(*h*)). In the description hereinafter, the signal HYENB is referred to as the horizontal enable signal. The color monitor 90 can display a video image which is available only in a time period when the horizontal enable signal HYENB is kept at an H level. The horizontal video effective period HE corresponds to the whole display range (between the left-end position A and the right-end position F) of the first video display area W01.

(5) Horizontal front porch time counter 114: A horizontal front porch time counter 114 generates a signal H4, which falls to an L level in response to the reset signal H5 and rises to an H level at an end of a horizontal front porch period HF (see FIG. 6(*d*)). The horizontal front porch period HF represents a time period between an end of the horizontal video effective period HE and a start of a horizontal reset period HR (a one-clock period of the dot clock signal DTCLK).

(6) Horizontal reset time counter 115: Horizontal reset time counter 115 generates the reset signal H5 for resetting the above counters 111 through 114 (see FIG. 6(*e*)). The signal H5 falls to an L level at a first rise of the dot clock signal DTCLK after a rise of the output signal H4 of the horizontal front porch counter 114, and rises again to an H level after one clock pulse. As described above, the counters 111 through 114 are reset at a fall of the signal H5 and the signals H1 through H4 fall to the L level.

The counters 111 through 115 function to generate the horizontal synchronizing signal HSYNC and define the time periods in the horizontal direction.

The video control signal generator 80 also has counters 121 through 125 for defining time periods in the vertical direction, which respectively correspond to the counters 111 through 115 described above. The vertical counters 121 through 125 use the horizontal synchronizing signal HSYNC (=H1) as a clock input instead of the dot clock signal DTCLK and are otherwise similar to the horizontal counters 111 through 115. This is clearly understood by comparing waveforms of output signals V1 through V5 of the vertical counters 121 through 125 shown in FIGS. 7(*a*) to 7(*e*) with those of the output signals E1 through H5 of the horizontal counters 111 through 115 shown in FIGS. 6(*a*) to 6(*e*). The CPU 50 sets time periods for the vertical counters 121 through 124, which are different from those for the corresponding horizontal counters 111 through 114.

Figure 7:
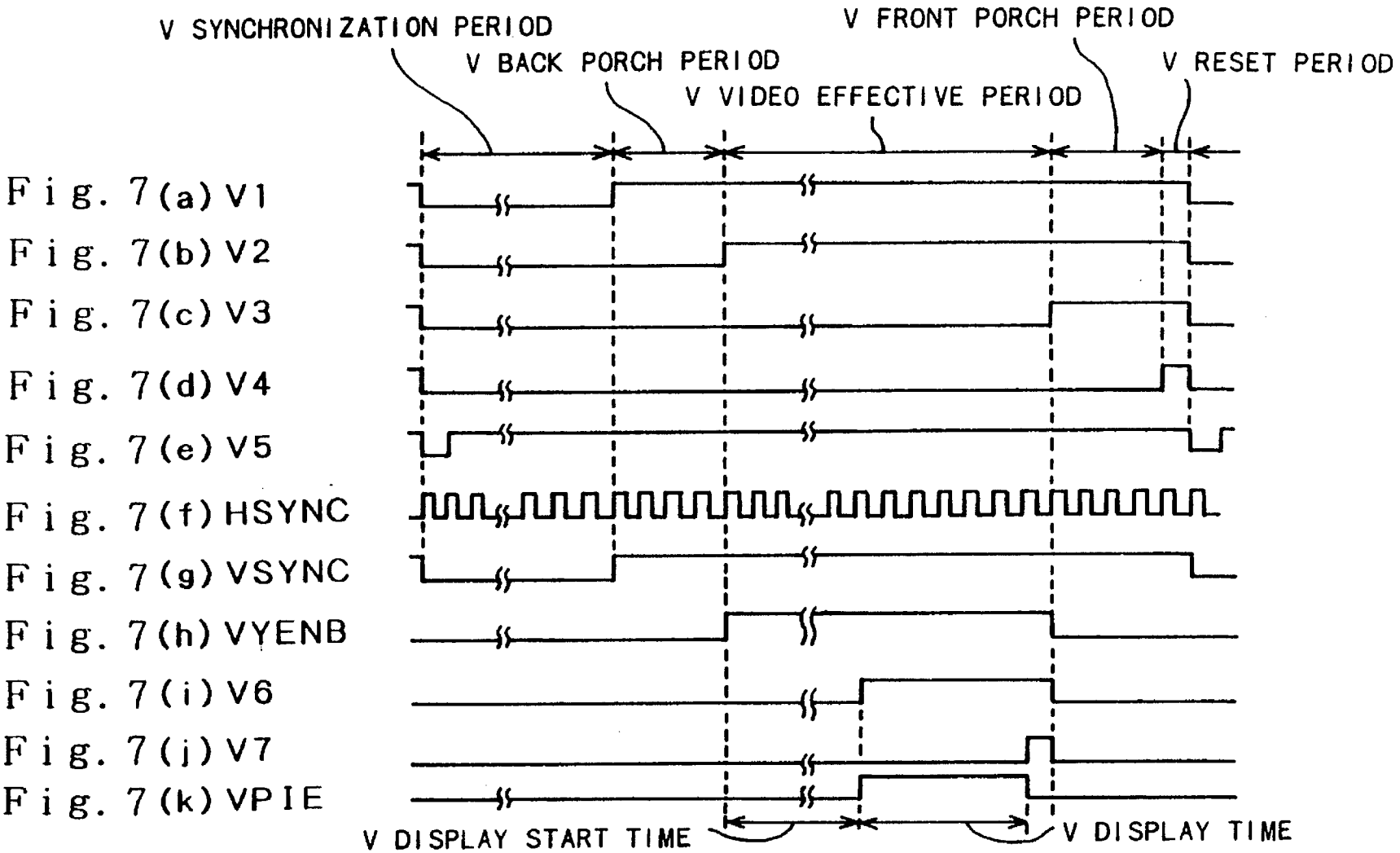
FIGS. 7(*a*) through 7(*k*) are timing charts showing the operation of the video control signal generator 80 in the vertical direction.

The video control signal generator 80 is also provided with an AND gate 126 for generating a vertical enable signal VYENB (FIG. 7(*h*), which corresponds to the AND gate 116 for generating the horizontal enable signal HYENB.

The video control signal generator 80 further includes three permit signal generator circuits 131 through 133 for generating the read-permit signals HPIE1-3 and VPIE1-3 given to the three memory control units 71 through 73. Each of the permit signal generator circuits 131 through 133 includes the following units:

(a) Horizontal display start time counter 134: Horizontal display start time counter 134 is activated at a rise of the horizontal enable signal HYENB to generate a signal H6 which rises to an H level at a start of a horizontal display period (see FIG. 6(*i*)). The counter 134 is reset at a fall of the horizontal enable signal HYENB. The horizontal display period represents a time period during which video images represented by the video data stored in the video memory units are displayed on the color monitor 90. In the timing chart of FIG. 4, the horizontal display period is a range between positions A and F for the first video display area W01, between positions B and D for the second video display area W02, and between the third video display area W03.

(b) Horizontal display time counter 135: Horizontal display time counter 135 is activated at the rise of the horizontal enable signal HYENB to generate a signal H7 which rises to an H level at an end of the horizontal display period (see FIG. 6(*j*)). The counter 135 is reset at the fall of the horizontal enable signal HYENB.

(c) AND gate 136: AND gate 136 makes a logical product of the signal H6 and an inversion of the signal H7 to generate the horizontal read-permit signal HPIE (FIG. 6(*k*)).

The permit signal generator circuits 131 through 133 also include two vertical counters 137 and 138 and an AND gate 139 for operations in the vertical direction, which correspond to the horizontal counters 134 and 135 and the AND gate 136, respectively. The AND gate 139 outputs the vertical read-permit signal VPIE (FIG. 7(*k*)). While the horizontal counters 134 and 135 use the dot clock signal DTCLK as a clock input and the horizontal enable signal HYENB as a reset input, the vertical counters 137 and 138 use the horizontal synchronizing signal HSYNC (=H1) as a clock input and the vertical enable signal VYENB as a reset input.

The number of the permit signal generator circuits 131 through 133 included in the video control signal generator 80 is the same as the number of the video memory units 61 through 63. The respective circuits 131–133 for the video memory units 61–63 generate the three pairs of read-permit signals (HPIE1, VPIE1), (HPIE2, VPIE2), and (HPIE3, VPIE3) shown in FIG. 4.

The CPU 50 sets the number of pulses for defining each time period in each of the counters 134, 135, 137 and 138 of the permit signal generator circuits 131 through 133. The CPU 50 determines these pulse numbers according to the dimensions, the positions, and the spatial arrangement of the video display areas W01 through W03 FIG. 4) specified on the color monitor 90 by the user.

As described above, the video control signal generator 80 generates the horizontal synchronizing signal HSYNC, the vertical synchronizing signal VSYNC, the read-permit signals HPIE1-E3 and VPIE1-3 shown in FIG. 4. As illustrated in FIG. 1, the horizontal synchronizing signal HSYNC and the vertical synchronizing signal VSYNC are supplied to the color monitor while the read-permit signals HPIE1-3 and VPIE1-3 are supplied to the memory control units 71–73.

C. Memory Control Unit and Video Memory Unit

Structures and operation of the memory control units 71 and 72 and the first and the second video memory units 61 and 62 are described in this section, and those of the 3-port memory control unit 73 and the 3-port video memory unit 63 will be described later.

Figure 8:
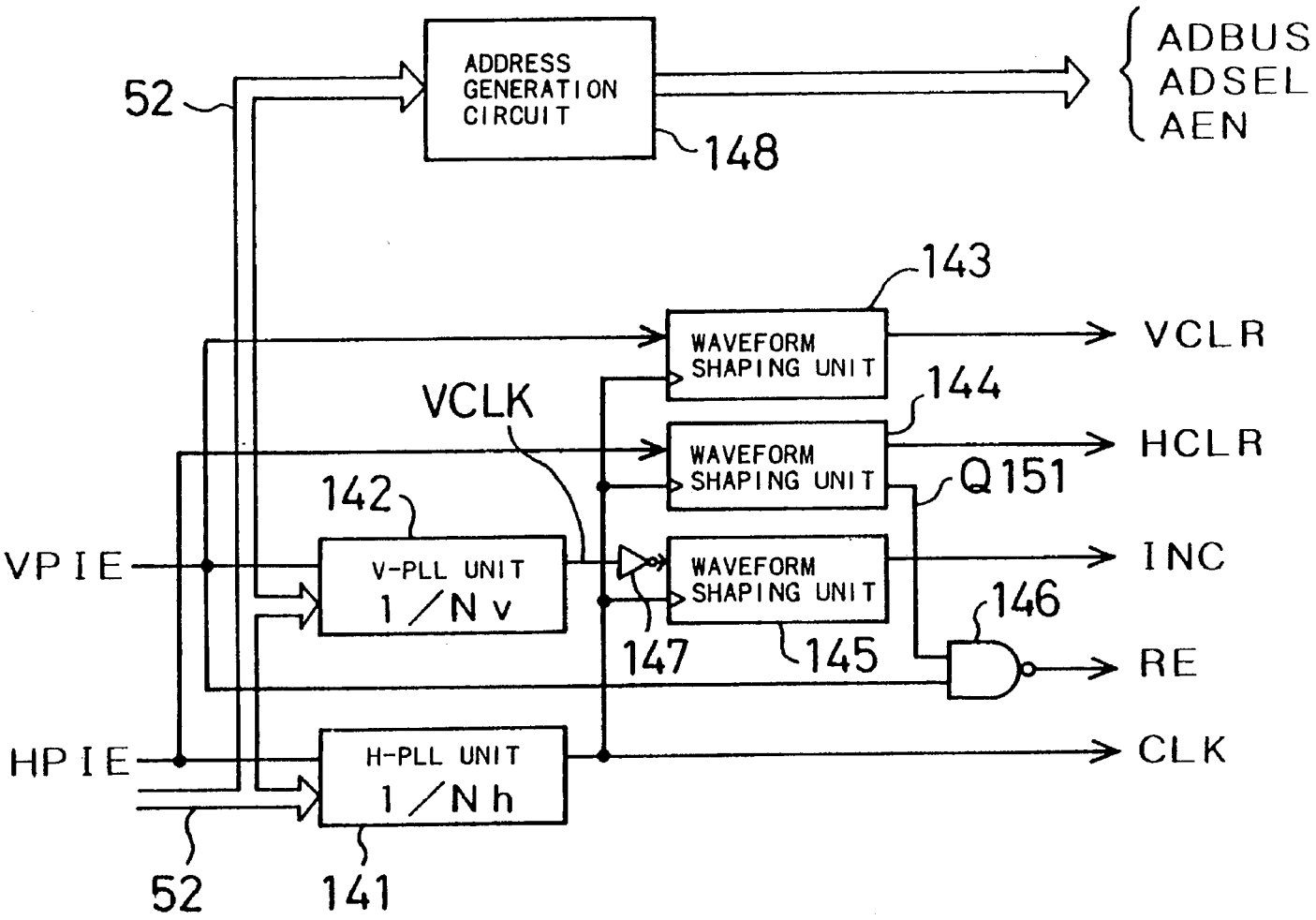
FIG. 8 is a block diagram illustrating the internal structure of the memory control unit 71.
Figure 9:
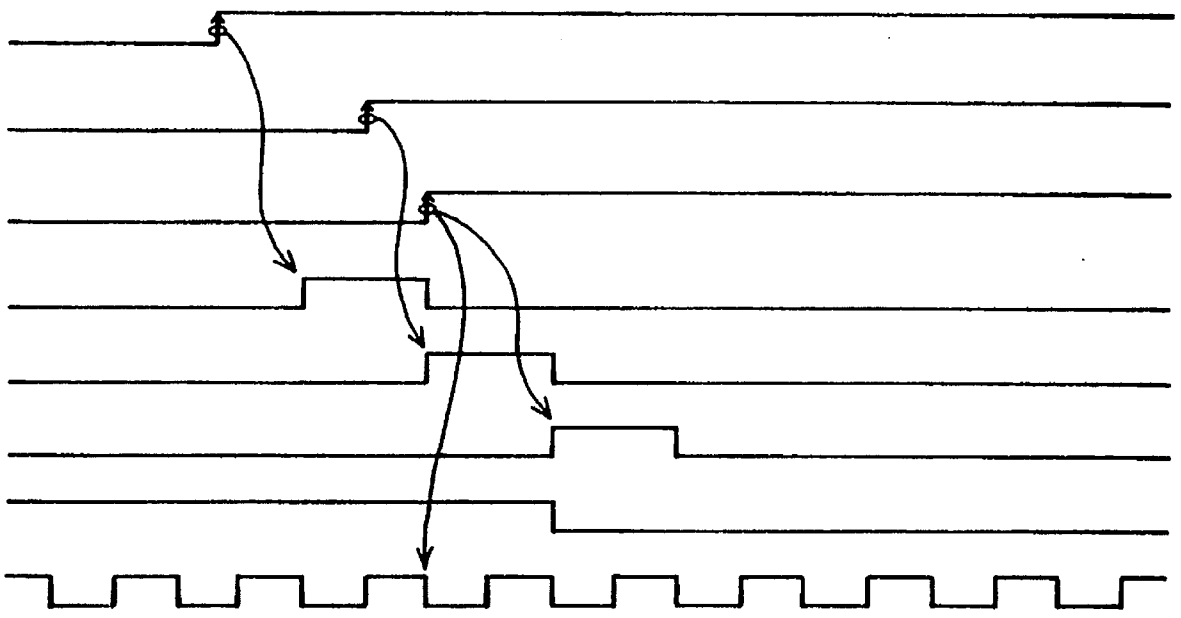
FIGS. 9(*a*) through 9(*h*) are timing charts showing the operation of the memory control unit 71.

FIG. 8 is a block diagram illustrating the internal structure of the first memory control unit 71, and FIG. 9(*a*) through 9(*h*) are timing charts showing the operation of the memory control unit 71. The memory control unit 71 includes an H-PLL unit 141, a V-PLL unit 142, three waveform shaping units 143 through 145, a NAND gate 146, an inverter 147, and an address generation circuit 148.

The H-PLL unit 141 is a PLL (phase-locked loop) circuit for generating a clock signal CLK (FIG. 9(*h*)) having a frequency whose value is Nh times the frequency of the horizontal read-permit signal HPIE, in which Nh represents the number of pixels corresponding to one cycle of the horizontal read-permit signal HPIE. The number of pixels Nh may be different from the number of pixels Wh in the horizontal direction of the video memory units 61 through 63 shown in FIGS. 2(B), 2(C), and 2(D). The CPU 50 can vary the value Nh in the H-PLL unit to expand or contract video images in the horizontal direction based on the relationship between Nh and Wh. Details of the expansion and contraction of video images will be described later. The H-PLL unit 141 locks the phase of the clock signal CLK synchronously with a rise-edge of the horizontal read-permit signal HPIE.

The V-PLL unit 142 is a PLL circuit for generating a signal VCLK (FIG. 9(*b*)) having a frequency whose value is Nv times the frequency of the vertical read-permit signal VPIE, in which Nv represents the number of lines corresponding to one cycle of the vertical read-permit signal VPIE. The number of lines Nv may be different from the number of lines Wv in the vertical direction of the video memory units 61 through 63 shown in FIGS. 2(B), 2(C), and 2(D). The CPU 50 can vary the value Nv in the V-PLL unit to expand or contract video images in the vertical direction based on the relationship between Nv and Wv.

Figure 10:
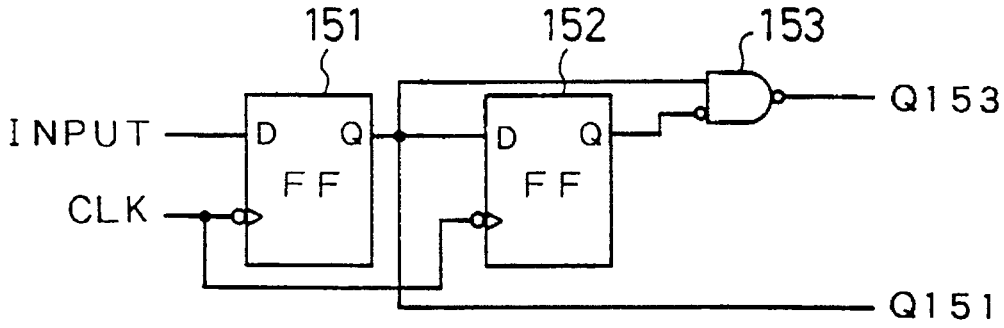
FIG. 10 is a block diagram illustrating the internal structure of a waveform shaping unit 143.

FIG. 10 is a block diagram illustrating the internal structure of the waveform shaping units 143, 144, and 145. Each waveform shaping unit includes two D-type flip-flops 151–152, and an AND gate 153. Clock input terminals of the two D-type flip-flops 151–152 receive the clock signal CLK generated by the H-PLL unit 141. An input to the waveform shaping unit is supplied to a D-input terminal of the first D-type flip-flop 151. An output of the first D-type flip-flop 151 is supplied to a D-input terminal of the second D-type flip-flop 152 and the AND gate 153. The AND gate 153 also receives an inversion of an output of the second flip flop 152.

Figure 11:
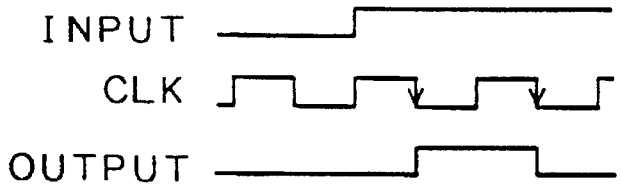
FIG. 11 are timing charts showing the operation of the waveform shaping unit 143.

FIG. 11 is a timing chart showing the operation of the waveform shaping units. The waveform shaping units 143 through 145 shown in FIG. 8 respectively receive the signals VPIE, HPIE, and /VCLK, wherein the symbol "/" affixed to VCLK means that the signal is an inversion of the signal VCLK. As illustrated in FIG. 11, output signals VCLR, HCLR, and INC from the respective waveform shaping units 143, 144, and 145 rise to an H level at a first down-edge of the clock signal CLK after a rise of the input signals VPIE, HPIE, and /VCLK, and fall to an L level at a second down-edge of the clock signal CLK.

As illustrated in FIG. 8, the clock input terminals of the three waveform shaping units 143 through 145 receive the clock signal CLK generated by the H-PLL unit 141. The vertical reset signal VCLR generated by the first waveform shaping unit 143 has one pulse every time when display of video images on one screen page is completed. The horizontal reset signal HCLR generated by the second waveform shaping unit 144 has one pulse every time when display of video images on one scanning line is completed. The vertical increment signal INC generated by the third waveform shaping unit 145 has one pulse every time when video data for one scanning line are read out. The horizontal reset signal HCLR and the vertical increment signal INC play important roles for expansion and contraction of video images in the vertical direction as described later.

The NAND gate 146 (FIG. 8) generates a read enable signal RE as a logical product of the output Q151 of the first D-type flip-flop 151 (FIG. 10) of the second waveform shaping unit 144 and the vertical read-permit signal VPIE.

The output signals VCLR, HCLR, INC, RE, and CLK of the first memory control unit 71 are transmitted to both the first video memory unit 61 and the memory unit 60.

The other memory control units 72 and 73 (FIG. 1) have the same structure as that shown in FIG. 8. The three memory control units, however, have different values for the number of pixels Nh set in the H-PLL unit 141 and the number of lines Nv set in the V-PLL unit 142. The settings of Nh and Nv will be described later in detail.

Figure 12:
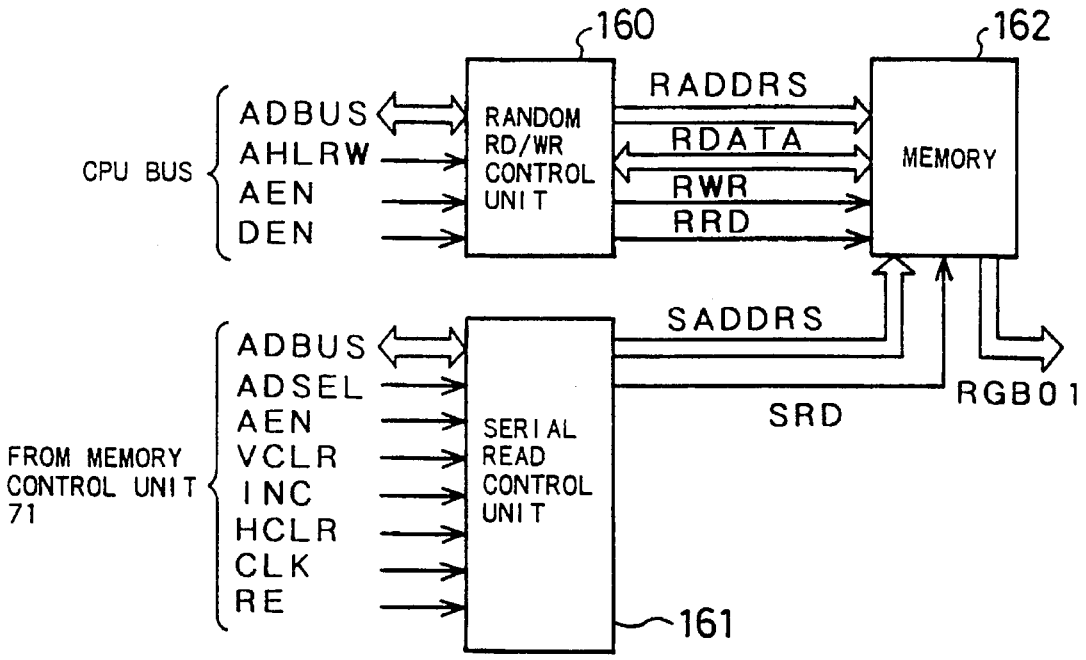
FIG. 12 is a block diagram illustrating the internal structure of the first video memory unit 61.

FIG. 12 is a block diagram illustrating the internal structure of the first video memory unit 61. The video memory unit 61 includes a random read/write control unit 160, a serial read control unit 161, and a memory 162. The memory unit 60 and the second video memory unit 62 also have these units.

The random read/write control unit 160 receives the following inputs:

ADBUS: An address/data common bus of the CPU bus 52;

AHLRW: A signal indicating either upper or lower addresses and either data-read or data-write;

AEN: A signal representing that the address bus is valid; and

DEN: A signal representing that the data bus is valid.

The random read/write control unit 160 generates the following outputs:

RADDRS: A random address;

RDATA: Random data;

RWR: A random write-in signal; and

RRD: A random read-out signal.

Inputs and outputs of the serial read control unit 161 include:

ADBUS: An address bus;

ADSEL: An address selection signal for selecting one of four addresses;

AEN: An address enable signal representing that the address bus ADBUS is valid;

VELR: A vertical reset signal having one pulse every time when display of video images on one screen page is completed;

INC: A vertical increment signal having one pulse every time when video data for one scanning line is read out;

HCLR: A horizontal reset signal having one pulse every time when display of video images on one scanning line is completed;

CLK: A clock signal;

RE: a read enable signal;

SADDRS: A serial address; and

SRD: A serial data read-permit signal.

Figure 13:
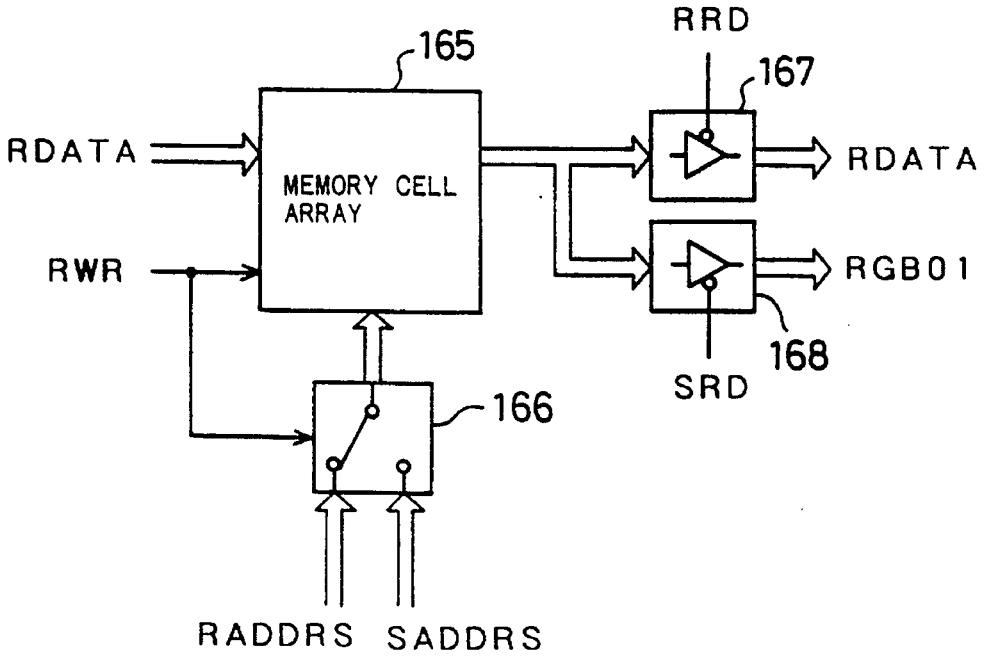
FIG. 13 is a block diagram illustrating the internal structure of the memory 162 of FIG. 12.

FIG. 13 is a block diagram illustrating the internal structure of the memory 162 of FIG. 12, which includes a memory cell array 165, a selector 166, and two 3-state buffers 167 and 168. The selector 166 selects either of the random address RADDRS and the serial address SADDRS responsive to the random write-in signal RWR, to supply the selected address to an address input terminal of the memory cell array 165. An output terminal of the memory cell array 165 transmits the random data RDATA via the first 3-state buffer 167. A control terminal of the first 3-state buffer 167 is supplied with the random read-out signal RRD. The output of the memory cell array 165 is given to the second 3-state buffer 168 and output as a video signal RGB01 to the video signal switching unit 82 (see FIG. 1). A control terminal of the second 3-state buffer 168 is supplied with the serial data read-permit signal SRD from the serial read control unit 161. The memory cell array 165 is preferably composed of static RAMs for high-speed display of moving pictures.

Figure 14:
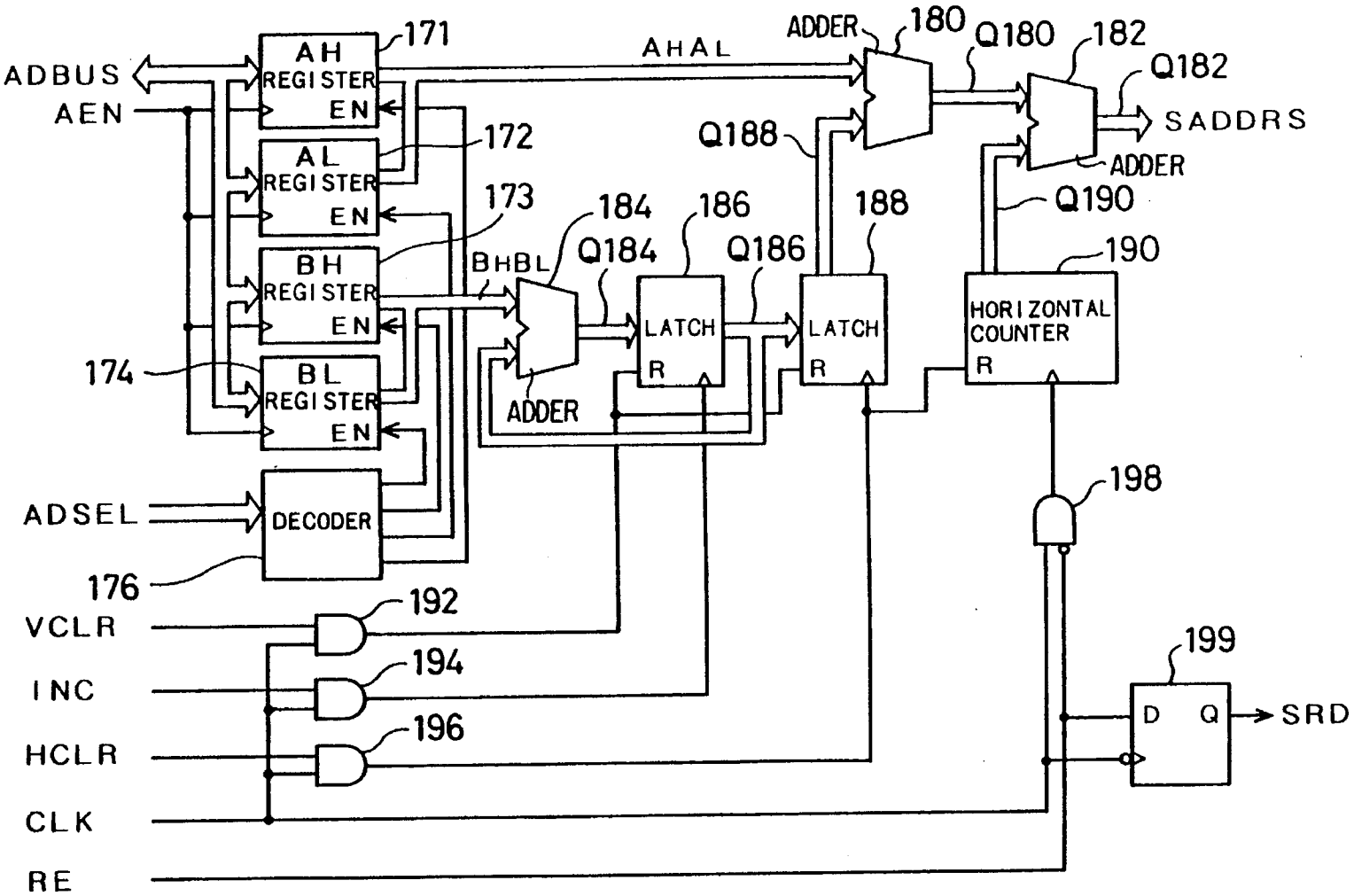
FIG. 14 is a block diagram illustrating the internal structure of the serial read control unit 161 of FIG. 12.

FIG. 14 is a block diagram illustrating the internal structure of the serial read control unit 161, and FIGS. 15(*a*) through 15(*o*) are timing charts showing the operation of the serial read control unit 161. The serial read control unit 161 includes four 8-bit address registers 171 through 174 and a decoder 176. The decoder 176 decodes the 2-bit address selection signal ADSEL to enable one of the four address registers 171 through 174 successively (see FIG. 15(*b*)). Addresses AH, AL, BH, and BL given from the address bus ADBUS (FIG. 15(*a*)) are successively stored in the address registers 171 through 174 at rise-edges of the address enable signal AEN supplied to the respective registers 171 through 174.

Figure 16A:
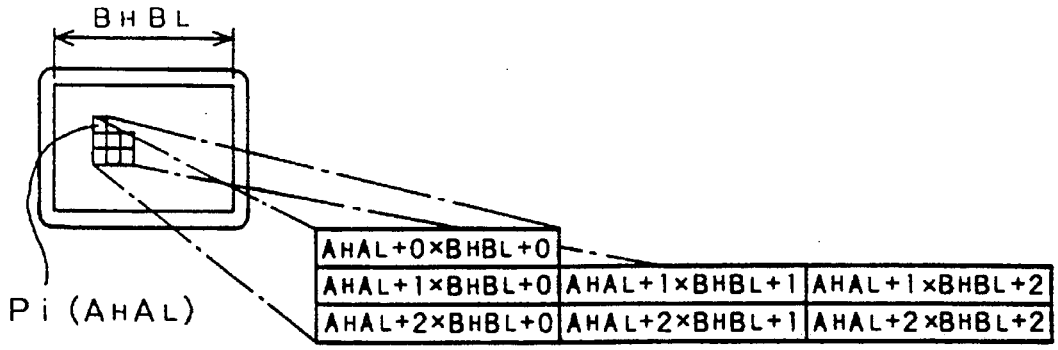
FIGS. 16(A) through 16(C) conceptually show the relationship between addresses of a memory and a display screen corresponding to the memory.
Figure 16B:
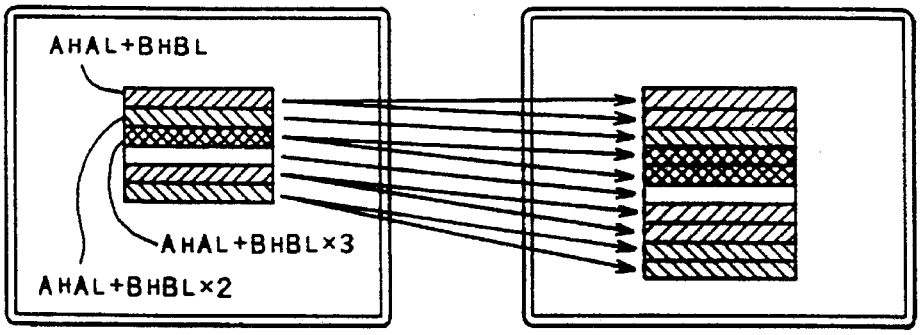
Figure 16C:
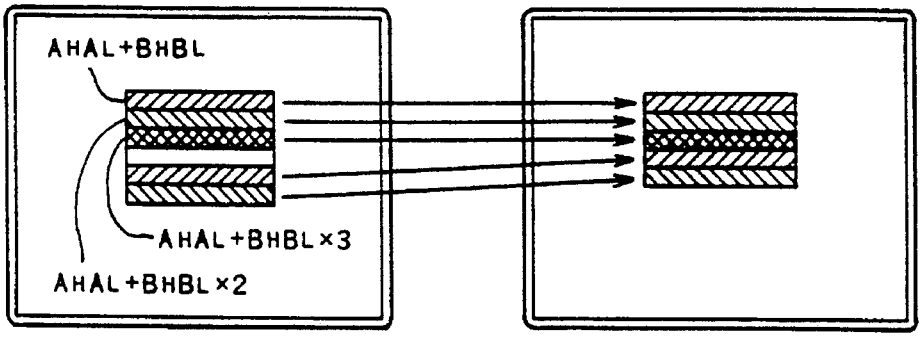

FIGS. 16(A) through 16(C) conceptually show the relationship between the addresses and the display screen corresponding to a memory area. An address AHAL (hereinafter referred to as "starting address") indicates an address reference point Pi located at an upper left position of an image area corresponding to video data. Another address BHBL (hereinafter referred to as "additional address") indicates an increase in the address corresponding to the length of one scanning line on the screen. In interlacing operations, the additional address BHBL depends on the ratio of the interlacing. In the 2:1 interlacing, for example, the additional address BHBL indicates an increase in the address corresponding to twice the length of the scanning line.

With reference again to FIG. 14, the serial read control unit 161 further includes three adders 180, 182, and 184 for calculating addresses in the scanning operation, two latches 186 and 188, a horizontal counter 190, and four AND gates 192, 194, 196, and 198. The adders 180 and 184 and the latches 186 and 188 constitute a circuit for calculating addresses in the vertical direction whereas the horizontal counter 190 implements a circuit for calculating addresses in the horizontal direction.

The adder 184 adds a 16-bit additional address BHBL stored in the two address registers 173 and 174 to an output Q186 of the first latch 186. The first latch 186 is reset at a rise-edge of an output signal of the first AND gate 192 and holds an output Q184 of the adder 184 at a rise-edge of an output signal of the second AND gate 194. The first AND gate 192 obtains a logical product of the vertical reset signal VCLR and the clock signal CLK. The first latch 186 is accordingly reset at a rise-edge of the clock signal CLK while the vertical reset signal VCLR is maintained at the H level as shown in FIG. 15(*j*). The second AND gate 194 obtains a logical product of the vertical increment signal INC and the clock signal CLK. The first latch 186 thus holds the output Q184 of the adder 184 at a rise-edge of the clock signal CLK while the vertical increment signal INC is kept at the H level.

The output Q186 of the first latch 186 is fed back to the adder 184. The output Q184 of the adder 184 is accordingly incremented by the additional address BHBL (see FIG. 15(*i*)) every time when the first latch 186 holds new data, that is, every time when one pulse of the vertical increment signal INC is generated.

The second latch 188 is reset at a rise-edge of the output signal of the first AND gate 192 and holds the output Q186 of the first latch 186 at a rise-edge of an output signal of the third AND gate 196. The third AND gate 196 obtains a logical product of the horizontal reset signal HCLR and the clock signal CLK. The second latch 188 thus holds the output Q186 of the first latch 186 at a rise-edge of the clock signal CLK while the horizontal reset signal HCLR is kept at the H level as shown in FIG. 15(*k*).

The first adder 180 adds an output Q188 of the second latch 188 to the starting address AHAL stored in the two address registers 171 and 172. An output Q180 of the first adder 180 corresponds to an address in the vertical direction.

The horizontal counter 190 is reset at a rise-edge of the output signal of the third AND gate 196 and counts up at a rise-edge of an output signal of the fourth AND gate 198. The fourth AND gate 198 obtains a logical product of an inversion of the read enable signal RE and the clock signal CLK. The horizontal counter 190 accordingly counts up at a rise-edge of the clock signal CLK while the read enable signal RE is kept at the L level as shown in FIG. 15(*l*). A count Q190 in the horizontal counter 190 corresponds to an address in the horizontal direction.

The second adder 182 adds the output Q180 of the first adder 180 to the count Q190 in the horizontal counter 190. An output Q182 of the second adder 182 is equal to a sum of the starting address AHAL, the output Q188 of the second latch 188 (FIG. 15(*k*)), and the count Q190 in the horizontal counter 190 (FIG. 15(*l*)). The output Q182 of the second adder 182 is supplied to the memory 162 as the serial address SADDRS. The serial address SADDRS is incremented by one from a sum of the starting address AHAL and the additional address BHBL in synchronism with a rise-edge of the clock signal CLK. The video data RGB01 including R, G, and B components are read serially out of the memory 162 according to the serial address SADDRS.

The serial read control unit 161 also includes a D-type flip-flop 199 as shown in FIG. 14. The D-type flip-flop 199 receives the read enable signal RE at its D-input terminal and the clock signal CLK at its clock input terminal, and outputs the serial data read-permit signal SRD (FIG. 15(*o*)). The serial data read-permit signal SRD falls to the L level at a first down-edge of the clock signal CLK after the read enable signal RE falls to the L level. Since the serial data read-permit signal SRD is given to the control terminal of the second 3-state buffer 168 as shown in FIG. 13, the video data RGB01 can be read out of the memory 162 only when the signal SRD is at the L level. As shown in FIGS. 15(*m*) and 15(*n*), the serial address SADDRS when the signal SRD falls to the L level has the value of (AHAL+BHBL), which corresponds to a position of the pixel immediately below the address reference point Pi shown in FIG. 16(A), and reading-out of the video data starts at this specific position accordingly. This means that an image on the address reference point Pi is not displayed.

Incidentally, the clock signal CLK is generated by the H-PLL unit 141 (FIG. 8), and the phase of the down-edge of the clock signal CLK is locked at the rise-edge of the horizontal read-permit signal HPIE (FIG. 9). The phase lock by the PLL circuit is, however, imperfect in general, and a little deviation or jitter may be found in the phase of the clock signal CLK. In the embodiment, serial read-out of video data is controlled at the rise-edges of the clock signal CLK as shown in FIGS. 15(*a*) through 15(*o*), and the jitter in the clock signal CLK thereby does not cause any problems in the data read-out operation.

FIGS. 17(*a*) through 17(*f*) are timing charts showing the operation of the serial read control unit 16 1 in vertical expansion of a video image. FIGS. 17(*a*) through 17(*f*) show only main signals relating to update of addresses in the vertical direction among the signals shown in FIGS. 15(*a*) through 15(*o*). The output Q184 of the adder 184 is incremented by the additional address BHBL at every pulse of the vertical increment signal INC while the output Q186 of the first latch 186 is incremented by the additional address BHBL at every pulse of the horizontal reset signal HCLR. At a time point t1, no pulse of the vertical increment signal INC is observed between the latest two pulses of the horizontal reset signal HCLR, and the output Q188 of the second latch 188 is thus kept unchanged. When a period Tv of the vertical increment signal INC is greater than a period Tv0 of the horizontal reset signal HCLR, the output Q188 of the second latch 188 (that is, the vertical address) sometimes repeats identical values as shown in FIG. 17(*f*). The horizontal reset signal HCLR has the same frequency as that of the horizontal synchronizing signal HSYNC given to the color monitor 90, and causes one pulse at every update of the scanning line on the screen. When the output Q188 of the second latch 188 varies as shown in FIG. 17(*f*), video images on some scanning lines stored in the memory are repeatedly displayed on the screen of the color monitor 90 as illustrated in FIG. 16(B). This results in expansion of video images in the vertical direction.

The magnification of the vertical expansion of a video image on the color monitor 90 is defined as a ratio of the period Tv of the vertical increment signal INC to the period Tv0 of the horizontal reset signal HCLR, or (Tv/Tv0). The period Tv of the vertical increment signal INC is adjusted by the preset value Nv in the V-PLL unit 142 (see FIG. 8).

FIGS. 18(*a*) through 18(*f*) are timing charts showing the operation of the serial read control unit 161 in vertical contraction of a video image. At a time point t2, two pulses of the vertical increment signal INC are observed between the latest two pulses of the horizontal reset signal HCLR, and twice the additional address BHBL is thus added to the output Q188 of the second latch 188. When the period Tv of the vertical increment signal INC is less than the period Tv0 of the horizontal reset signal HCLR, the output Q188 of the second latch 188 sometimes skips some integral multiples of the additional address BHBL as shown in FIG. 18(*f*). In the example of FIG. 18 (*f*), the value BHBLX4 is skipped. Video images on some scanning lines stored in the memory are accordingly not displayed on the screen of the color monitor 90 as illustrated in FIG. 16(C). This results in contraction of a video image in the vertical direction.

As shown in FIGS. 17(*a*) through 18(*f*), the serial read control unit 161 adds the additional address BHBL multiplied by the number of pulses of the vertical increment signal INC observed between the latest two pulses of the horizontal reset signal HCLR to the output Q188 of the second latch 188 (that is, the vertical address) every time it receives one pulse of the horizontal reset signal HCLR. When no pulse of the vertical increment signal INC is observed between the latest two pulses of the horizontal reset signal HCLR as in the case of the time point t1 of FIG. 17(*f*), the vertical address Q188 is kept uncharged. When two pulses of the vertical increment signal INC are observed between the latest two pulses of the horizontal reset signal HCLR as is the case with the time point t2 of FIG. 18(*f*), on the other hand, twice the additional address BHBL is added to the vertical address Q188.

Like the magnification of expansion, the magnification of vertical contraction of a video image on the color monitor 90 is defined as the ratio of the period Tv of the vertical increment signal INC to the period Tv0 of the horizontal reset signal HCLR, or (Tv/Tv0).

D. Various Settings in Video Image Scaling

The computer system of the embodiment can vary the positions and dimensions of the video display areas W01 through W03 (FIG. 4) as well as scaling of video images. Scaling of video images is implemented by the H-PLL units 141 and the V-PLL units 142 of the memory control units 71 through 73 (see FIGS. 1 and 8) and the serial read control unit 161 (see FIG. 14) while change in the positions or the dimensions of the video display areas is implemented by the permit signal generator circuits 131 through 133 (see FIG. 5) corresponding to the respective video display areas.

Figure 19A:
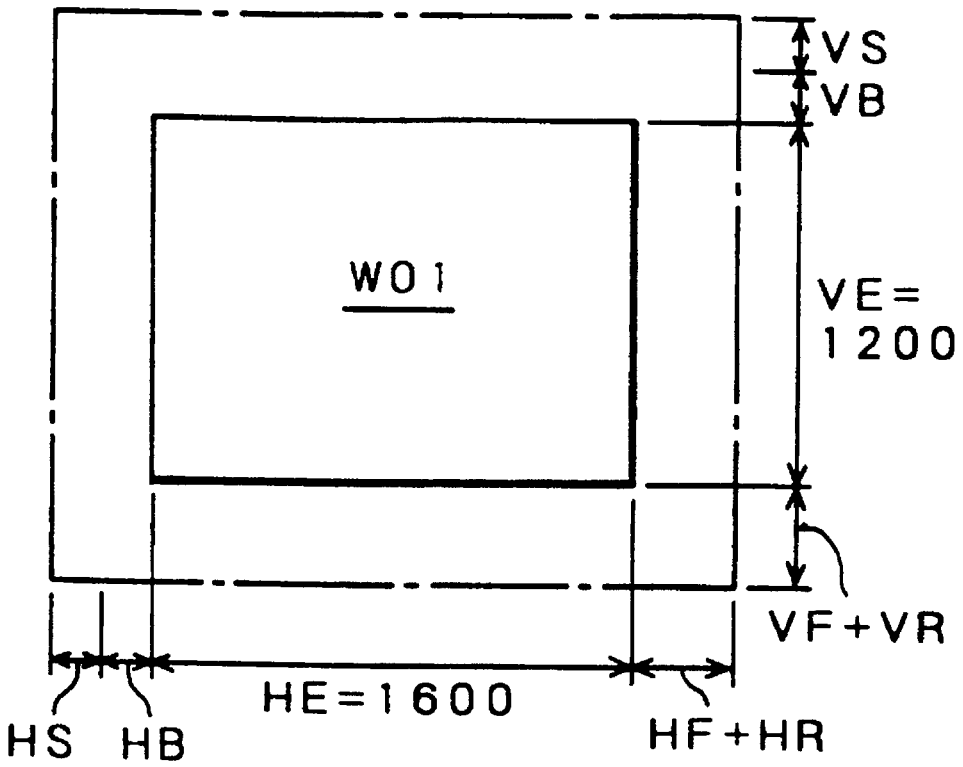

FIGS. 19(A) and 19(B) show various settings in the memory control units 71 and 72 (see FIG. 8) and the permit signal generator circuits 131 and 132 (see FIG. 5) when only a video image stored in the first video memory unit 61 is displayed.

In the drawing of FIG. 19(A), the overall horizontal period of signals relating to the first video display area W01 is divided into the horizontal synchronization period HS, the horizontal back porch period HB, the horizontal video enable period HE, the horizontal front porch period HF, and the horizontal reset period HR as explained along with FIG. 6. A preset value Nh0 of the H-PLL unit 141 of the first memory control unit 71 (FIG. 8) is equal to a sum of these periods (HS+HB+BE+HF+HR) expressed in terms of the number of pixels. The horizontal video enable period HE of the first video display area W01 corresponds to 1,600 pixels. One pulse of the clock signal CLK supplied from the H-PLL unit 141 corresponds to one pixel in the serial reading of video signals as shown in the timing chart of FIGS. 15(*a*)

through 15(*o*). A frequency fh0 of the clock signal CLK is equal to a product of the preset value Nh0 in the H-PLL unit 141 and the frequency of the horizontal read-permit signal HPIE1 for the basic video display area W01, that is, a product of the value Nh0 and the frequency of the horizontal synchronizing signal HSYNC supplied from the video control signal generator 80 to the color monitor 90. In this embodiment, the frequency fh0 is set equal to 100 MHz.

A preset value Nv0 in the V-PLL unit 142 of the first memory control unit 71 is equal to a sum of a vertical synchronization period VS, a vertical back porch period VB, a vertical video available period VE, a vertical front porch period VF, and a vertical reset period VR, or (VS+VB+VE+VF+VR), expressed in terms of the number of lines. The vertical video enable period VE of the first video display area W01 corresponds to 1,200 lines. A frequency fv0 of the vertical increment signal INC supplied from the V-PLL unit 142 is equal to a product of the preset value Nv0 of the V-PLL unit 142 and the frequency of the vertical read-permit signal VPIE1 for the basic video display area W01, that is, a product of the value Nv0 and the frequency of the vertical synchronizing signal VSYNC supplied from the video control signal generator 80 to the color monitor 90. In this embodiment, the frequency fv0 is set equal 80 KHz.

Preset values in the four counters 134, 135, 137, and 138 included in the first permit signal generator circuit 131 (see FIG. 5) are used to define the position and dimensions of the first video display area W01 within the display screen. A preset value Kh1 in the horizontal display start time counter 134 and a preset value Kv1 in the vertical display start time counter 137 are equal to zero for the basic or first video display area W01.

A preset value Kh2 in the horizontal display time counter 135 represents the horizontal video enable period HE expressed in terms of the number of pulses of the dot clock signal DTCLK (FIG. 5). The frequency of the dot clock signal DTCLK is preferably set equal to the frequency of the horizontal clock signal CLK1 (FIGS. 8 and 15) for the first video display area W01, which is 100 MHz in this embodiment. When the frequency of the dot clock signal DTCLK is equal to the frequency of the clock signal CLK1, the preset value Kh2 in the counter 135 becomes equal to the number of pixels (=1,600) in the horizontal video enable period HE.

A preset value Kv2 in the vertical display time counter 138 represents the vertical video enable period VE expressed in terms of the number of pulses of the horizontal synchronizing signal HSYNC. As described before, the frequency of the horizontal synchronizing signal HSYNC is equal to the frequency of the vertical increment signal INC1 (FIGS. 8 and 15) for the first video display area W01, which is 80 KHz in this embodiment. The preset value Kv2 in the counter 138 is thus equal to the number of lines (=1,200) in the vertical video enable period VE.

Figure 20A:
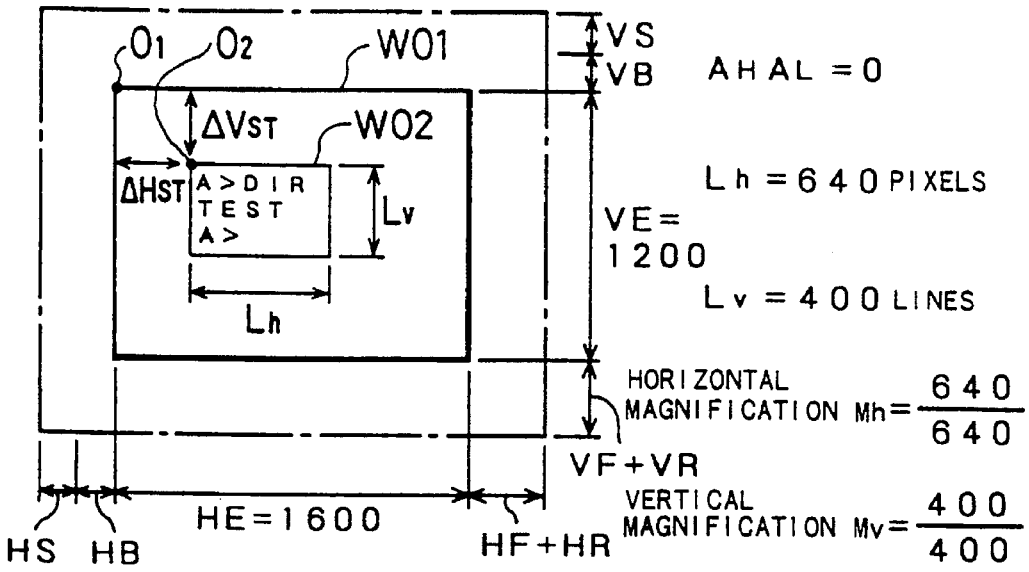

FIGS. 20(A) and 20(B) show various settings in the memory control units and the permit signal generator circuits when a video image stored in the second video memory unit 62 is displayed in the first video display area W01. In this example, the video image stored in the second video memory unit 62 is neither expanded nor contracted, and displayed totally.

It is possible to scale the video image stored in the first video memory unit 61 and to change the positions and the dimensions of its video display area. In this embodiment, however, the image scaling and positional- and dimensional-changes are not applied to the video image stored in the first video memory unit 61. The settings for the video image in the first video memory unit 61 are accordingly kept as those shown in FIGS. 19(A) and 19(B).

As for the video image stored in the second video memory unit 62, the CPU 50 determines the various settings according to the following equations, and sets the values thus determined in the respective circuits:

$$N_h = \mathrm{INT}\left(\frac{N_{h0}}{M_h}\right),\ N_v = \mathrm{INT}\left(\frac{N_{v0}}{M_v}\right)$$

$$f_h = \frac{f_{h0}}{M_h},\ f_v = \frac{f_{v0}}{M_v}$$

$$K_{h1} = \Delta H_{ST},\ K_{h2} = L_h$$

$$K_{v1} = \Delta V_{ST},\ K_{v2} = L_v$$

The operator 'INT' denotes an operation which decimal places of the value in brackets are cut out to leave only an integral. Mh represents the magnification of a video image in the horizontal direction, and Mv the same in the vertical direction; AHsT and AVST respectively denote offsets in the horizontal and vertical directions from an origin 01 located at an upper left position of an effective video area of the basic video display area W01 to an end point 02 located at an upper left position of the second video display area W02; and Lh and Lv represent widths of the second video display area W02 in the horizontal and the vertical directions.

When the video image stored in the second video memory unit 62 is neither expanded nor contracted, both the magnifications Mh and Mv are equal to one, and the preset value Nh in the H-PLL unit 141 and the preset value Nv in the V-PLL unit 142 in the second memory control unit 72 are equal to the corresponding settings in the first memory control unit 71. Since the whole second video display area w02 is displayed in the example of FIG. 20(A), the preset value Kh2 in the horizontal display time counter 135 and the preset value Kv2 in the vertical display time counter 138 in the second permit signal generator circuit 132 are respectively set equal to 640 pixels and 400 lines representing the maximum of the second video display area w02.

Figure 21A:
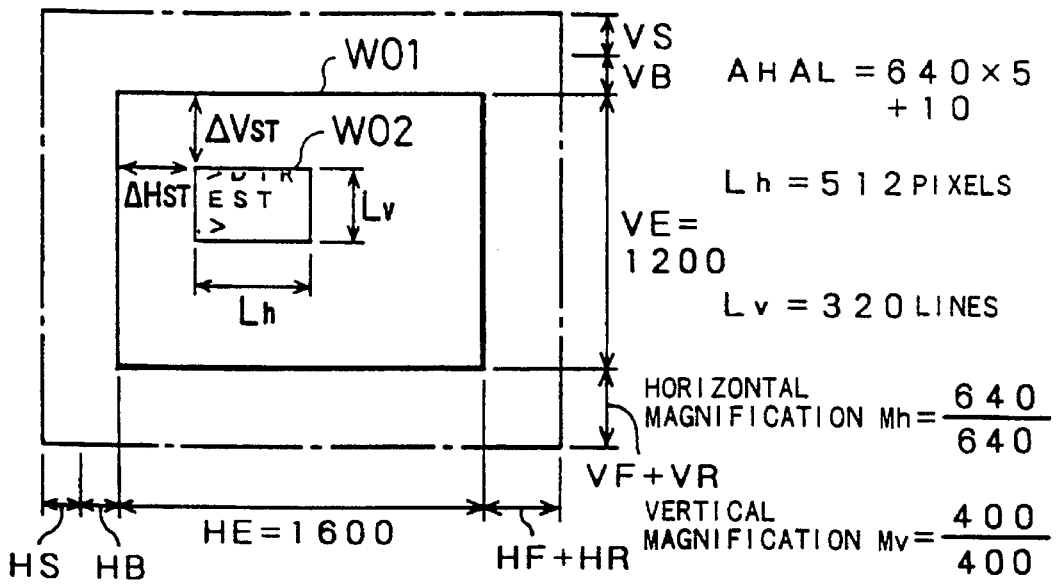

FIGS. 21(A) and 21(B) show various settings of the memory control units and the permit signal generator circuits when the video image stored in the second video memory unit 62 is neither expanded nor contracted and displayed only partly. When only part of the video image is displayed, the horizontal width Lh and the vertical width Lv of the video image are set in the counters 135 and 138 whereas the other settings shown in FIG. 21(B) are kept as the standard values. In the example of FIG. 21(A) , the starting address AHAL is set equal to (640×5+10), where the value 640 represents the number of pixels for one scanning line and corresponds to the additional address BHBL shown in FIG. 16(A). This means that the starting address AHAL or the address reference point Pi (FIG. 16(A)) is set equal to a tenth pixel on a fifth line in the drawing of FIG. 21(A). Since the address reference point Pi is a standard in reading video data out of the video memory, video data stored in an arbitrary area of the video memory can be read out by varying the starting address AHAL.

Figure 22A:
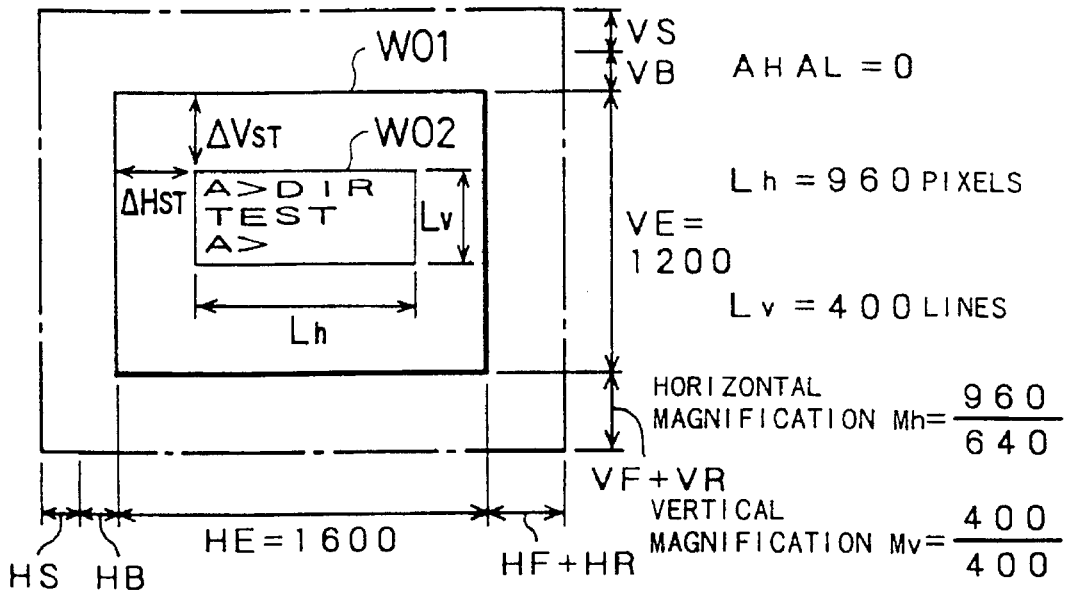

FIGS. 22(A) and 22(B) show various settings in the memory control units and the permit signal generator circuits when the video image stored in the second video memory unit 62 is expanded in the horizontal direction and displayed totally. In this case, the preset value Nh in the H-PLL unit 141 of the second memory control unit 72 is set equal to a quotient of the standard value Nh0 divided by the horizontal magnification Mh. The preset value Kh2 in the horizontal display time counter 135 of the second permit signal generator circuit 132 is set equal to a product of the standard value (=640) and the horizontal magnification Mh (=960/640), which is 960 in this embodiment.

The horizontal magnification Mh can be input directly through keystrokes on the keyboard or alternatively determined by the CPU 50 according to the user's specification of the dimensions of the second video display area W02 with the mouse. In the latter case, the horizontal magnification Mh is determined by dividing the horizontal width Lh of the second video display area W02 by the standard width (640 pixels for the second video image).

The variation in the horizontal magnification Mh changes a frequency fh of the horizontal clock signal CLK2 of the second memory control unit 72. Since one pulse of the clock signal CLK2 corresponds to one pixel of the second video display area W02, the variation in the horizontal magnification Mh changes the period of the clock signal CLK2 corresponding to one pixel. The clock signal CLK2 is used as a synchronizing clock for reading video signals out of the video memory unit 61 as shown in FIGS. 15(*a*) through 15(*o*), and also used as a synchronizing clock signal DACLK of the D-A converter 86. When the video image is expanded in the horizontal direction, the frequency of the clock signal CLK2 is varied according to the frequency of video signals read out of the video memory unit 62. The D-A conversion of video signals in synchronism with the clock signal CLK2 allows video images to be displayed with a preferably high picture quality.

Video images can be contracted in the horizontal direction by setting the horizontal magnification Mh less than 1. There are no differences between the operation of the horizontal image expansion and that of the horizontal image contraction.

Figure 23A:
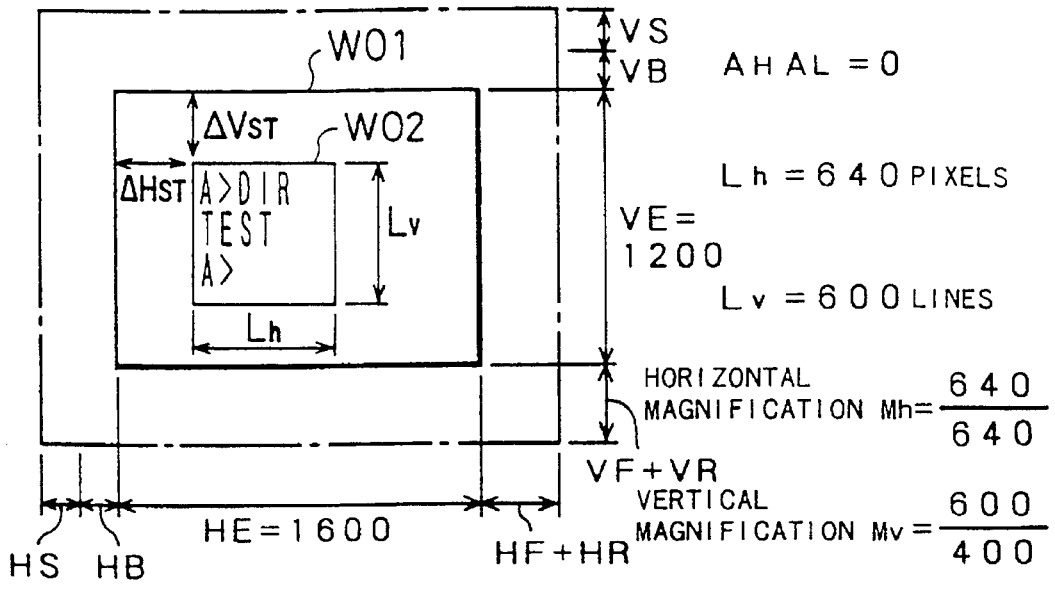

FIGS. 23(A) and 23(B) show various settings in the memory control units and the permit signal generator circuits when the video image in the second video display area W02 is expanded in the vertical direction and displayed totally. In this case, the preset value Nv in the V-PLL unit 142 of the second memory control unit 72 is set equal to a quotient of the standard value Nv0 divided by the vertical magnification Mv(=600/400). The preset value Kv2 in the vertical display time counter 138 of the second permit signal generator circuit 132 is set equal to a product of the standard value (=400) and the vertical magnification My, which makes 600 in this embodiment. The vertical magnification Mv is specified by a user in the same manner as the horizontal magnification Mh described before. The serial read control unit 161 executes the expansion of video images in the vertical direction according to the timing charts of FIGS. 17(*a*) through 17(*f*).

Figure 24A:
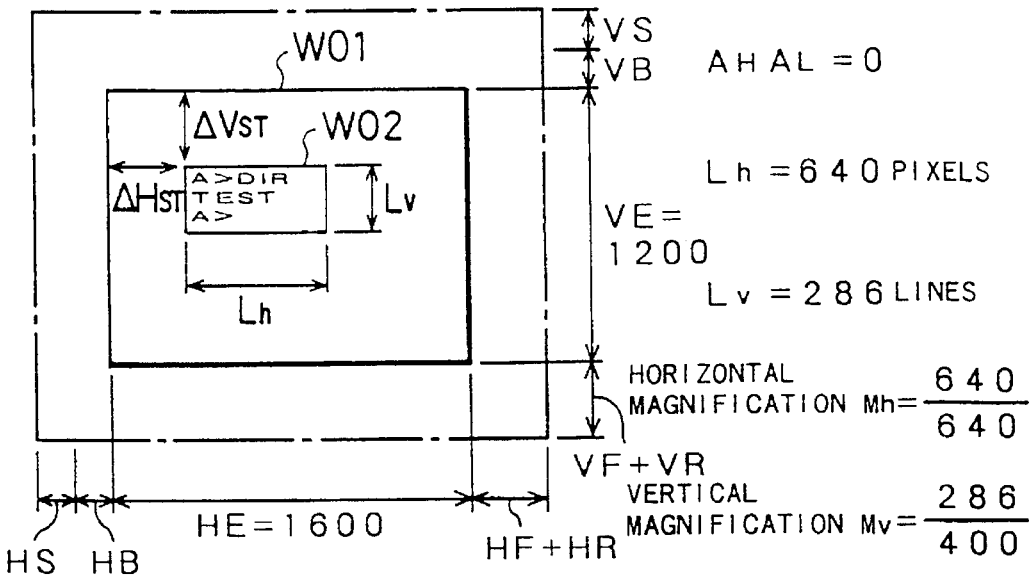

FIGS. 24(A) and 24(B) show various settings in the memory control units and the permit signal generator circuits when the video image in the second video display area W02 is contracted in the vertical direction and displayed totally. In the case of the vertical contraction, like the vertical expansion, the preset value Nv in the V-PLL unit 142 is set equal to a quotient of the standard value Nv0 divided by the vertical magnification Mv(=286/400), and the preset value Kv2 in the vertical display time counter 138 is set equal to a product of the standard value (=400) and the vertical magnification Mv. The serial read control unit 161 executes the contraction of video images in the vertical direction according to the timing charts of FIGS. 18(*a*) through 18(*f*).

As described above, the H-PLL units 141, the V-PLL units 142 (FIG. 8) and the serial read control unit 161 (FIG. 14) implement expansion and contraction of video images while the permit signal generator circuits 131 through 133 (FIG. 5) change the positions and dimensions of video display areas.

Although the scaling of the video image stored in the second video memory unit 62 and the dimensional- and positional-change of the second video display area W02 are described above, the same processes can be applied to the other video images stored in the other two video memory units 61 and 63. Those values of the horizontal magnification Mh, the vertical magnification My, the offsets of the video display area ΔHsT and ΔVsT, the widths Lh and Lv of the video display area (that is, the preset values Kh2 and Kv2), and the starting address AHAL can be set independently.

E. Moving Picture Write Control Unit

Figure 25:
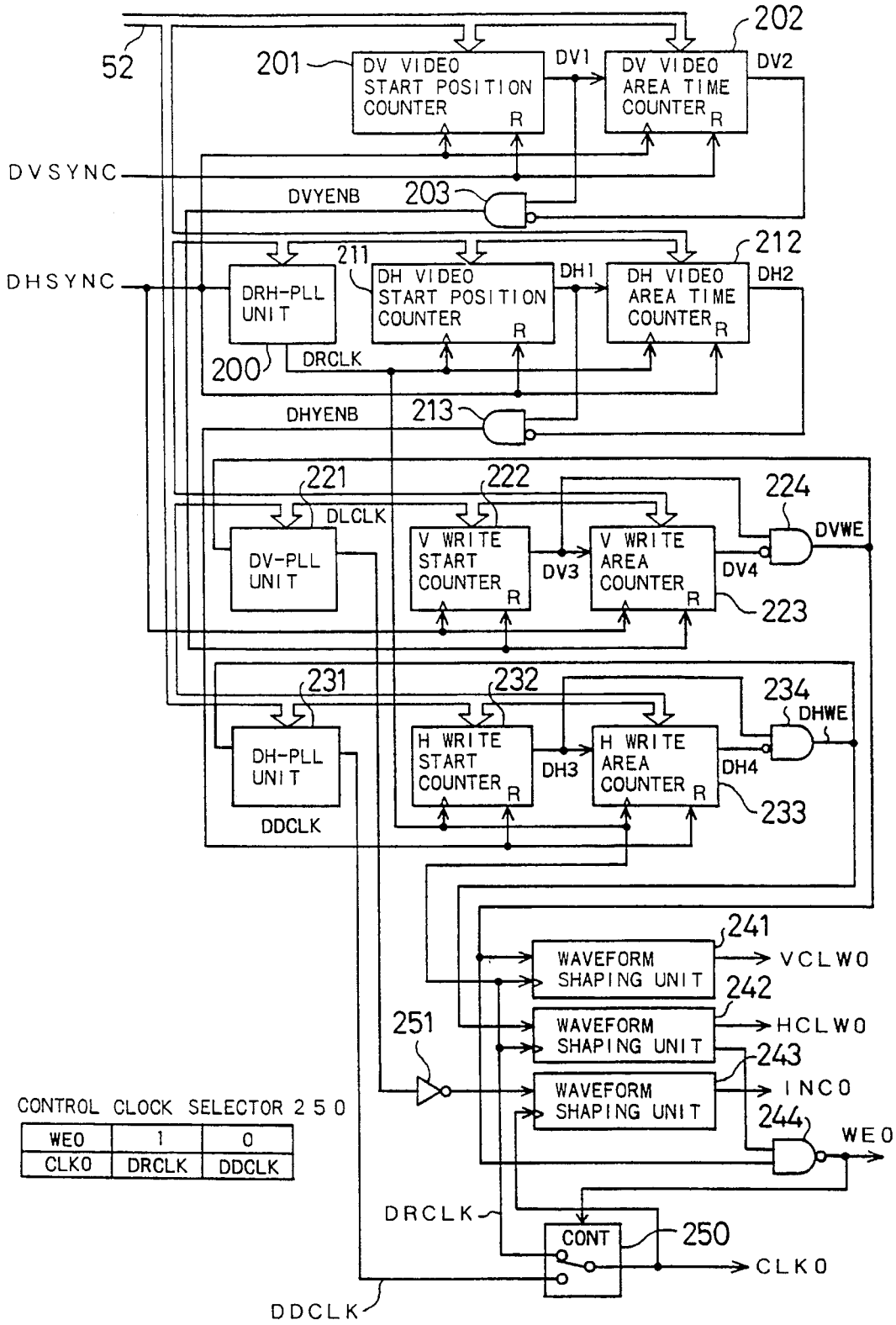
FIG. 25 is a block diagram illustrating the internal structure of the moving picture write control unit 74.

FIG. 25 is a block diagram illustrating the internal structure of the moving picture write control unit 74. Most of the elements of the moving picture write control unit 74 correspond to those of the video control signal generator 80 shown in FIG. 5 and of the memory control unit 71 shown in FIG. 8.

The following elements of FIG. 25 correspond to those of FIG. 5:

DRH-PLL unit 200 to the DPLL unit 100;

Vertical video start position counter 201 to the vertical back porch time counter 122;

Vertical video area time counter 202 to the vertical video effective time counter 123;

AND gate 203 to the AND gate 126;

Horizontal video start position counter 211 to the horizontal back porch time counter 112;

Horizontal video area time counter 212 to the horizontal video effective time counter 113;

AND gate 213 to the AND gate 116;

Vertical write start counter 222 to the vertical display start time counter 137;

Vertical write area counter 223 to the vertical display time counter 138;

AND gate 224 to the AND gate 139;

Horizontal write start counter 232 to the horizontal display start time counter 134;

Horizontal display area counter 233 to the horizontal display time counter 135; and AND gate 224 to the AND gate 136.

The following elements of FIG. 25 correspond to those of FIG. 8:

DV-PLL unit 221 to the V-PLL unit 142;

DH-PLL unit 231 to the H-PLL unit 141;

Waveform shaping units 241 through 243 to the waveform shaping units 143 through 145;

NAND gate 244 to the NAND gate 146; and

Inverter 251 to the inverter 147.

A control clock selector 250 of FIG. 25 is not included in the circuit of FIG. 5 or in that of FIG. 8. Although the moving picture write control unit 74 has a circuit similar to the address generation circuit 148 shown in FIG. 8, the circuit is omitted from FIG. 25 for convenience of illustration.

Figure 26:
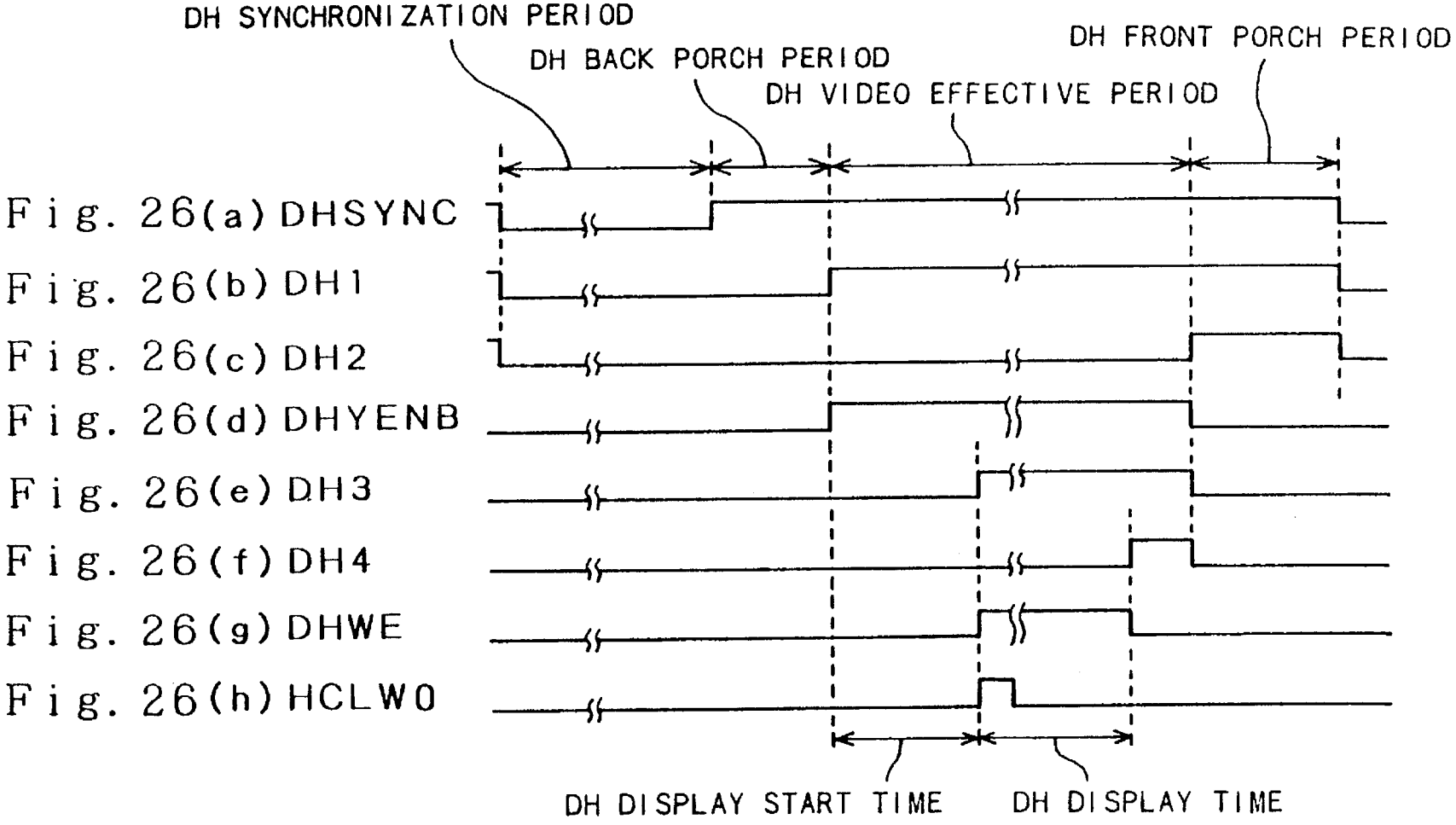
FIGS. 26(*a*) through 26(*h*) are timing charts showing the horizontal control operation of the moving picture write control unit 74.
Figure 27:
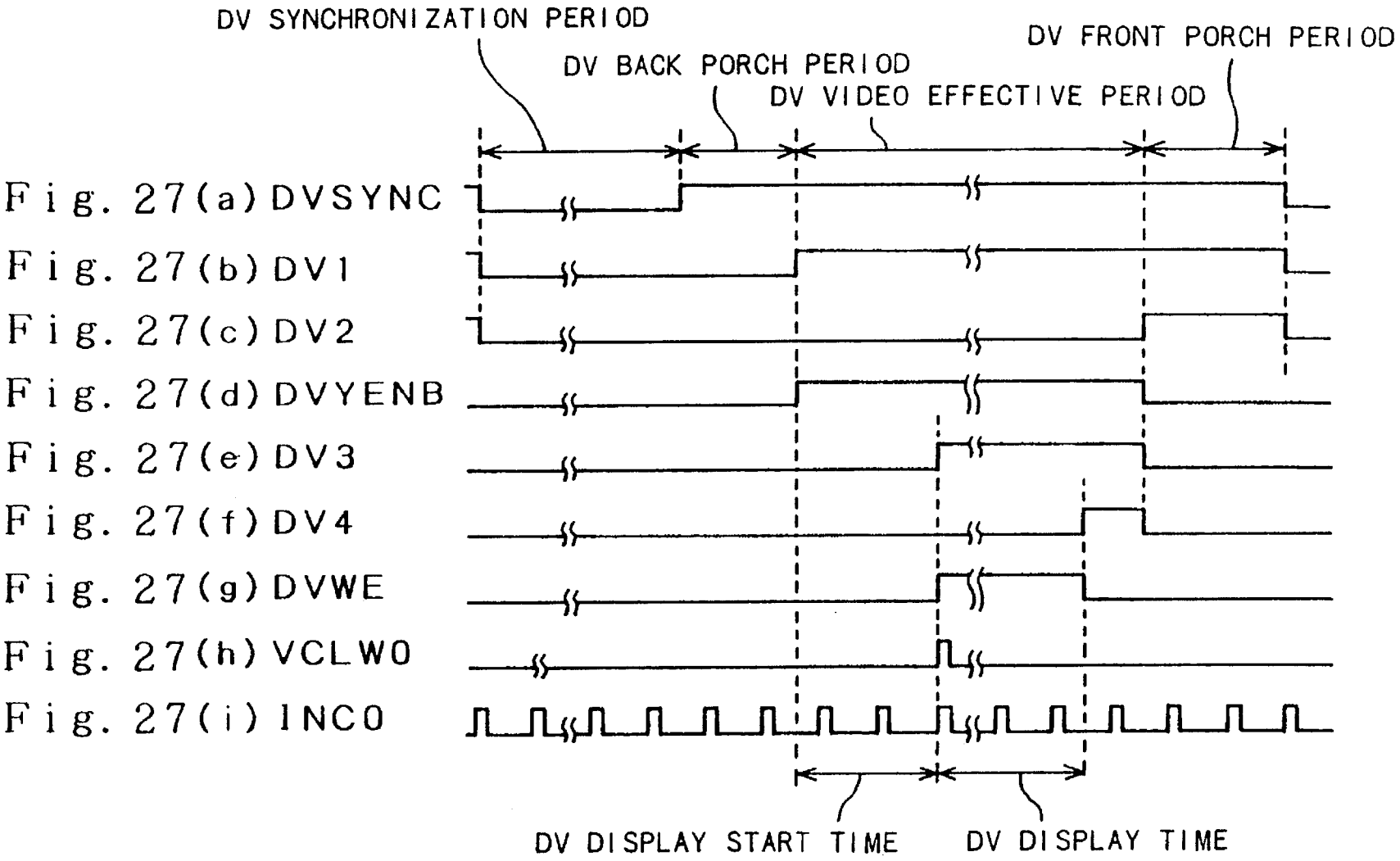
FIGS. 27(*a*) through 27(*i*) are timing charts showing the vertical control operation of the moving picture write control unit 74.

The moving picture write control unit 74 controls the display period of each video image in synchronism with a vertical synchronizing signal DVSYNC and a horizontal synchronizing signal DHSYNC supplied from the video signal separating/digitizing control unit 76 (see FIG. 1). FIGS. 26(*a*) through 27(*i*) are timing charts showing the operation of the moving picture write control unit 74 in the horizontal direction and in the vertical direction. The timing charts correspond to those of FIGS. 6(*a*) through 7(*k*), and are thus not described here.

The control clock selector 250 selects a first clock signal DRCLK generated by the DRH-PLL unit 200 when a write enable signal WE0, which corresponds to the read enable signal RE in FIG. 8, is at a level '1' (write protect level), and selects a second clock signal DDCLK generated by the DH-PLL unit 231 when the write enable signal WE0 is at a level '0' (write permit level). One pulse of the first clock signal DRCLK corresponds to one pixel of the basic or first video display area W01. One pulse of the second clock signal DDCLK corresponds to one pixel in a video image scaled in the horizontal direction, and the second clock signal DDCLK is synchronous with video signals written in the video memory unit 63. When video signals are written in the third video memory unit 63, the control clock selector 250 selects the second clock signal DDCLK, which is synchronous with the video signals to be written, to supply the same to the third video memory unit 63. While no video signals are written in the third video memory unit 63, on the other hand, the control clock selector 250 supplies the first clock signal DRCLK, which is synchronous with the basic video image, to the third video memory unit 63.

The moving picture write control unit 74 generates various signals VCLW0, HCLW0, INC0, WE0, and CLK0 used for writing video signals into the third video memory unit 63 and transmits these signals to the third video memory unit 63. These signals respectively correspond to the signals VCLR, HCLR, INC, RE, and CLK of FIG. 8 and are not described here in detail.

F. 3-Port Video Memory Unit

Figure 28:
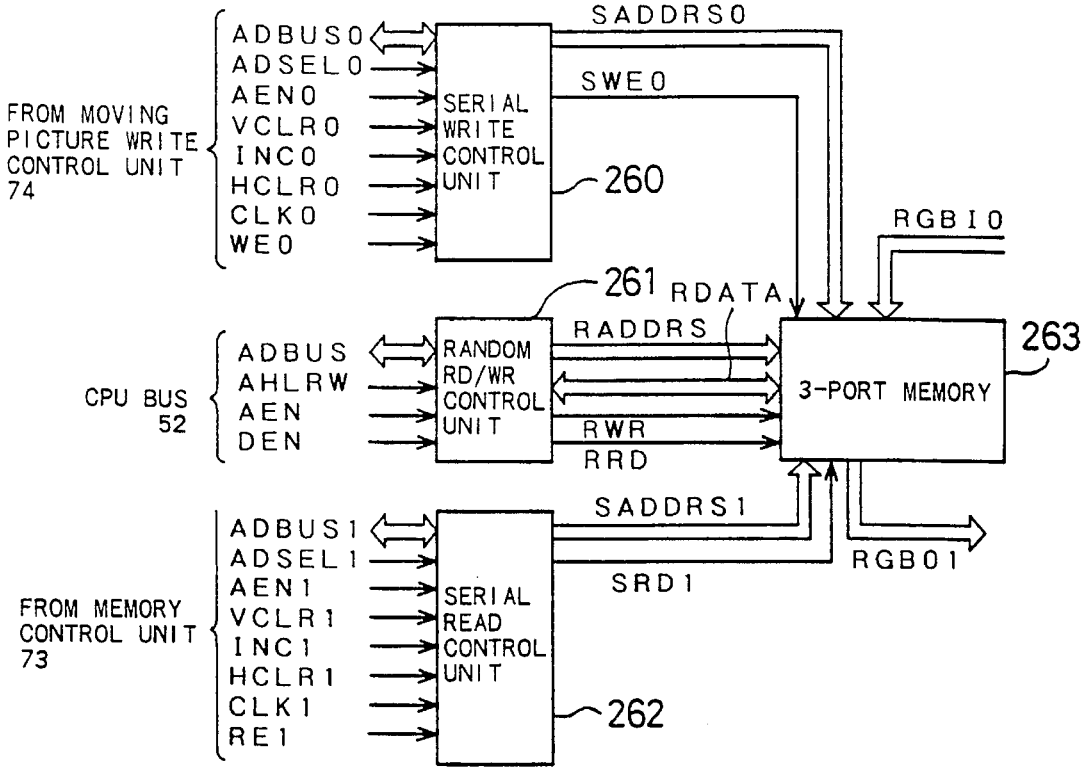
FIG. 28 is a block diagram illustrating the internal structure of the 3-port video memory unit 63.

FIG. 28 is a block diagram illustrating the internal structure of the 3-port video memory unit 63, which includes a serial write control unit 260, a random read/write control unit 261, a serial read control unit 262, and a 3-port memory 263. The random read/write control unit 261 has the same structure as the random read/write control unit 160 shown in FIG. 12, and the serial read control unit 262 has the same structure as the serial read control unit 161.

Figure 29:
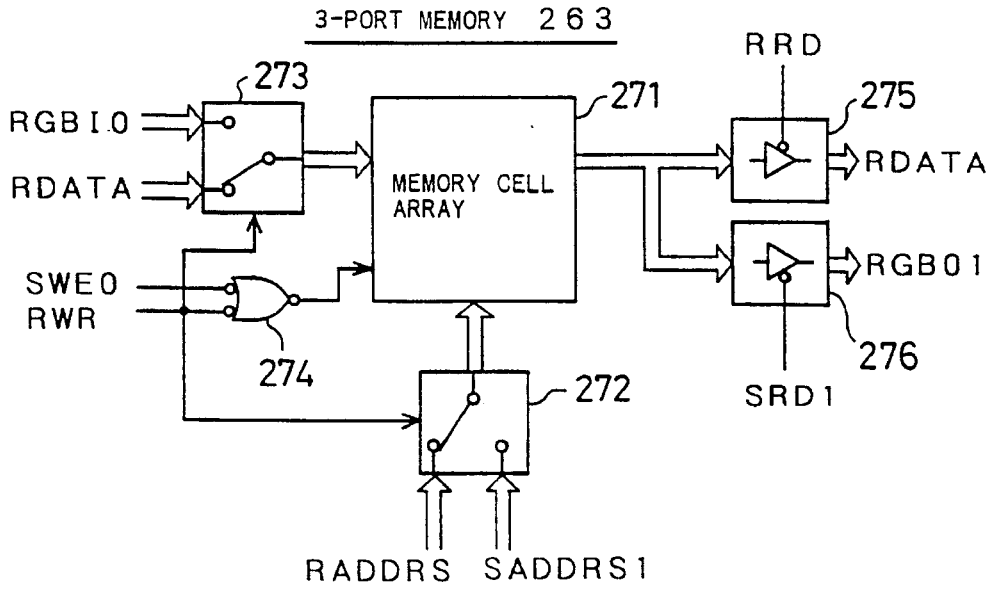
FIG. 29 is a block diagram illustrating the internal structure of the 3-port memory 263.

FIG. 29 is a block diagram illustrating the internal structure of the 3-port memory 263, which includes a memory cell array 271, two selectors 272 and 273, an AND gate 274, and two 3-state buffers 275 and 276. The first selector 272 has the same functions as the selector 166 shown in FIG. 13, and the two 3-state buffers 275 and 276 have the same functions as the 3-state buffers 167 and 168 of FIG. 13.

The second selector 273 selects one of random data RDATA and serial data RGBI0 according to a random write signal RWR supplied from the random read/write control unit 261, and transmits the selected data to the memory cell array 271. The AND gate 274 enables the writing operation of the memory cell array 271 when at least one of a serial data write-permit signal SWE0 supplied from the serial write control unit 260 and the random write signal RWR supplied from the random read/write control unit 261 is at the L level.

Figure 30:
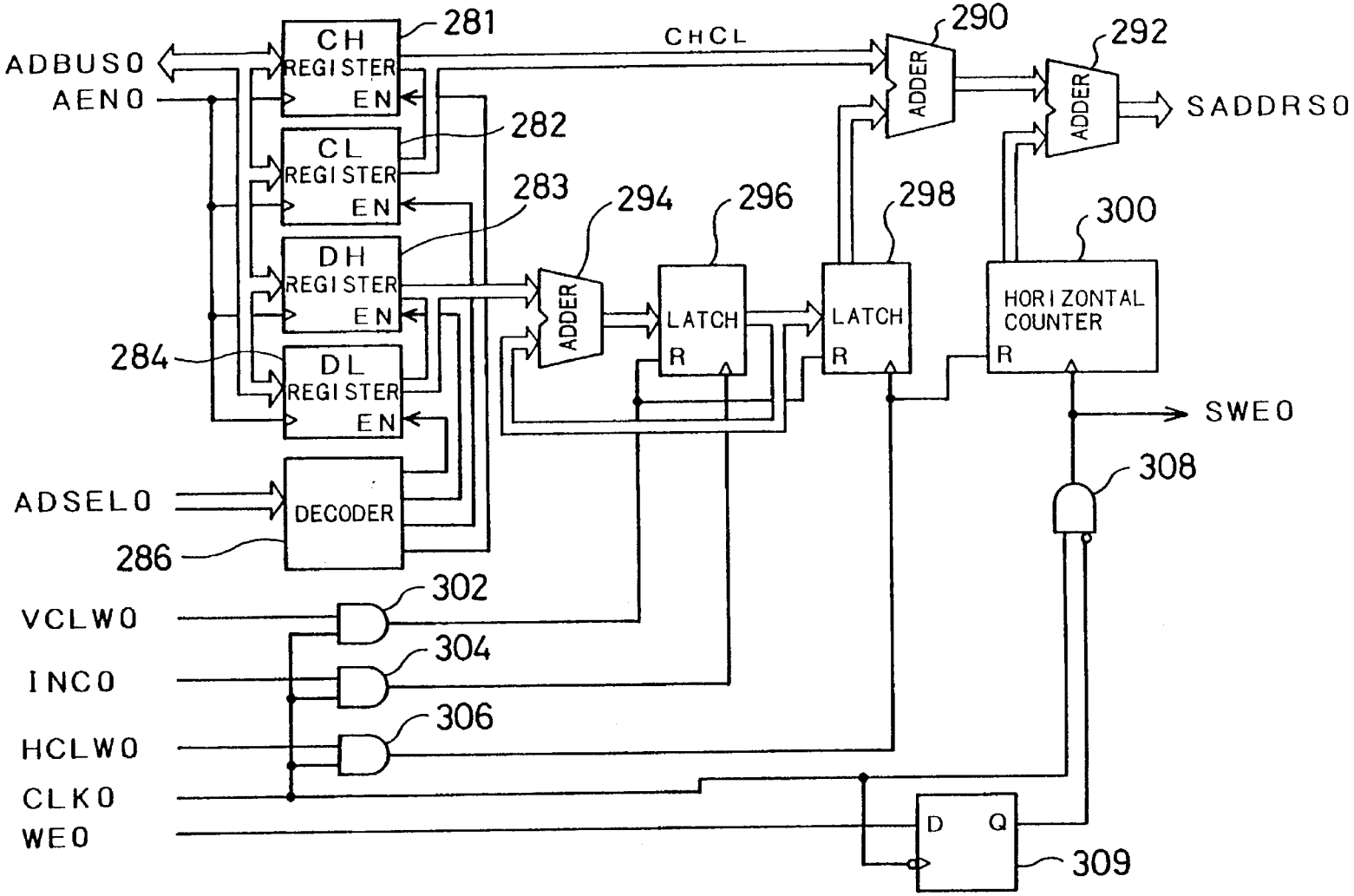
FIG. 30 is a block diagram illustrating the internal structure of the serial write control unit 260.

FIG. 30 is a block diagram illustrating the internal structure of the serial write control unit 260, which has elements 281 through 284, 286, 290, 292, 294, 296, 298, 300, 302, 304, 306, and 308 which are identical with the elements 171 through 174, 176, 180, 182, 184, 186, 188, 190, 192, 194, 196, and 198 of the serial read control unit 161 shown in FIG. 14, respectively. Only differences between the serial read control unit 161 and the serial write control unit 260 are that the AND gate 308 receives an inversion of an output of the D-type flip-flop 309 and that an output of the AND gate is supplied to the serial write control unit 260 as the write permit signal SWE0 while, in the serial read control unit 161, an output of the D-type flip-flop 199 is directly output as the serial data read permit-signal SRD.

FIGS. 31(*a*) through 31(*k*) are timing charts showing the operation of the serial write control unit 260, which are substantially the same as those of the serial read control unit 161 shown in FIG. 15, and the detailed description will be omitted here. The serial write control unit 260 writes video data in an arbitrary memory area of the 3-port memory 263 while executing the contraction of video images in the vertical direction and the expansion or contraction in the horizontal direction.

G. Modifications

Figure 32:
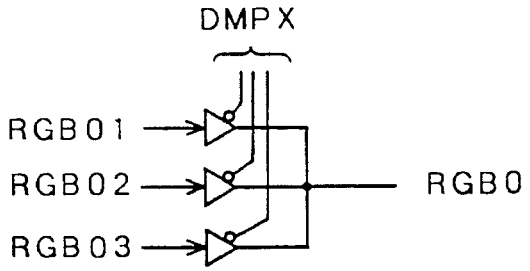
FIG. 32 is a block diagram showing another structure of the video signal switching unit.

There may be many modifications, alternations, and changes without departing from the scope or spirit of essential characteristics of the invention, for example, as follows:

(1) A video signal switching unit 82*a* comprising three 3-state buffers shown in FIG. 32 can be used in place of the video signal switching unit 82 composed of a selector (multiplexer) shown in FIG. 1. In the circuit of FIG. 32, one of the three 3-state buffers is enabled with a signal DMPX which is obtained by decoding the multiplexing signal MPX.

Figure 33:
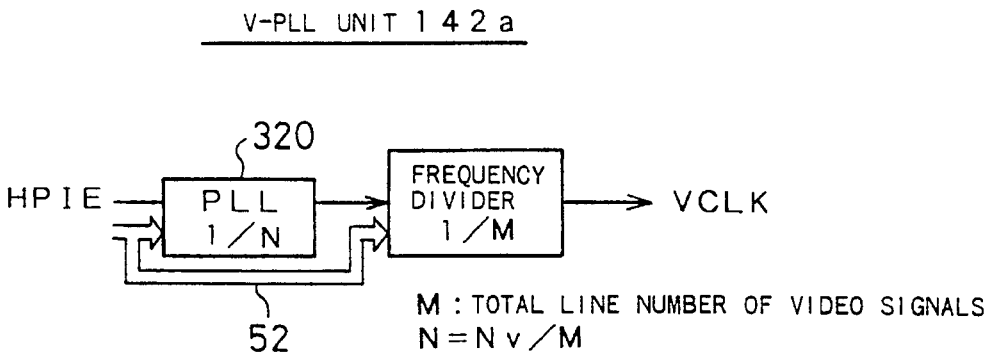
FIG. 33 is a block diagram showing another structure of the V-PLL unit.

(2) A V-PLL unit 142*a* shown in FIG. 33, including a PLL circuit 320 and a frequency divider 321, can be used in place of the V-PLL unit 142 of FIG. 8. The PLL circuit 320 is supplied with the horizontal read-permit signal HPIE. A preset value N of the PLL circuit 320 is set equal to a product of the preset value Nv in the V-PLL unit 142 of FIG. 8 and a frequency division rate 1/M of the frequency divider 321, where M represents the total number of lines on one screen page. Since the horizontal read-permit signal HPIE has a higher frequency than the vertical read-permit signal VPIE, which is supplied the V-PLL unit 142 of FIG. 8, undesirable jitter of the output signal VCLK can be effectively reduced.

(3) When the horizontal scaling operation is executed for the video image read out of the second video memory unit 62, the clock signal CLK2 output from the second memory control unit 72 has a frequency fh different from the frequency fh0 of the basic clock signal CLK1. This is also the case with a clock signal CLK3 output from the third video memory unit 63. When the video images are not scaled in the horizontal direction, however, the three clock signals CLK1 through CLK3 have an identical frequency. Therefore the first clock signal CLK1 can be used for video signals read out of the second and the third video memory units 62 and 63 when no horizontal scaling of video images is required. In this case, the clock signal switching unit 84 can be omitted from the circuit of FIG. 1, and the first clock signal CLK1 is supplied directly to the D-A converter 86.

(4) Although video images are displayed on the color monitor 90 as a function of analog video signals in the embodiment of FIG. 1, another display device for displaying video images as a function of digital video signals can be used alternatively. In such a case, the D-A converter 86 and the amplifier 88 are omitted, and a digital video signal RGB0 selected by the video signal switching unit 82 and a clock signal DACLK selected by the clock signal switching unit 84 are directly supplied to the digital video display device.

(5) The memory control means of the claimed invention is implemented by the combination of the serial read control units (FIGS. 12 and 28) included in the video memory units 61 through 63 with the three memory control units 71 through 73 (FIG. 8). The read control units and the write control units of the video memory units 61 through 63 can be included in memory chips implementing the video memory units 61 through 63, or alternatively disposed in the circuits of the memory control units 71 through 73.

(6) The selecting signal generation means of the claimed invention is implemented by the memory unit 60, and the multiplexing signal MPX (FIG. 1) corresponds to the video selecting signal of the claimed invention. Various circuits other than the memory unit 60 can, however, be used as the means for outputting the multiplexing signal MPX. For example, an alternative circuit can be used which memorizes positional data representing positions of the respective four corners of the three video display areas W01 through W03 shown in FIG. 4, determines the switching positions A through F for each scanning line based on the positional data, and generates the multiplexing signal MPX according to the switching positions. Another circuit can be the one which stores multiplexing data as run length data of each scanning line in a memory and generates the multiplexing signal MPX based on the run length data. These alternative circuits can reduce the memory capacity required for multiplexing data.

(7) In the above embodiment, the multiplexing signal MPX is read out by supplying the various signals generated by the memory control unit 71 to the memory unit 60. The system may have a separate control unit exclusively used for the memory unit 60. However, the above embodiment has an advantage of having the smaller number of the circuits because the signals generated by the memory control unit 71 are supplied to the memory unit 60.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A video display apparatus, for use in a computer system, for simultaneously displaying a plurality of video images on a display screen, the apparatus comprising:

a plurality of video memories for storing a plurality of video signals, respectively;

video control signal generation means for generating a plurality of read-permit signals indicating times for reading said plurality of video signals from said plurality of video memories, respectively;

memory control means for generating a plurality of read control signals from said plurality of read-permit signals and for supplying said plurality of read control signals to said plurality of video memories to allow said plurality of video signals to be read out of said plurality of video memories, said memory control means comprising means for generating a plurality of clock signals which are different from each other and respectively synchronous with said plurality of video signals read out of said plurality of video memories;

selection signal generating means for generating a video selection signal which indicates a change in selection of said plurality of video signals at a plurality of positions on the display screen;

first selection means for selecting one of said plurality of video signals in response to said video selection signal;

second selection means for selecting one of said plurality of clock signals corresponding to the one of said plurality of video signals selected by said first selection means in response to said video selection signal; and display means including the display screen for displaying a video image as a function of the one of said plurality of video signals and the one of said plurality of clock signals selected by said first and second selection means, respectively.

2. A video display apparatus as claimed in claim 1, wherein said selection signal generating means comprises:

a memory, having a memory area corresponding to a specific area including a plurality of pixels on the display screen, for storing video selection data which indicates to select one of said plurality of video signals for each of said plurality of pixels; and control signal supply means for supplying a selection data read control signal to said memory to read out said video selection data from said memory as said video selection signal.

3. A video display apparatus as claimed in claim 2, wherein said control signal supply means comprises a transmission path for transmitting one of said plurality of read control signals to said memory as said selection-data read control signal.

4. A video display apparatus as claimed in claim 1, wherein said display means comprises a digital-to-analog converter for converting a digital video signal selected by said selection means to an analog video signal in response to said clock signal selected by said selection means.

5. A video display apparatus as claimed in claim 1, wherein said plurality of video memories comprises a first video memory;

said video control signal generation means comprises means for generating a first signal having a first period which corresponds to a scanning time for one scanning line on the display screen of said display means; and said memory control means comprises:

a first PLL circuit for generating from said first signal a first clock signal having a period which is N1 times the first period of said first signal, where N1 is an integer;

horizontal address generation means for generating a horizontal address for said first video memory, said horizontal address generation means comprising horizontal address update means for increasing said horizontal address in response to each pulse of said first clock signal;

vertical address generation means for generating a vertical address for said first video memory; and address combining means for combining said vertical address and said horizontal address to produce an address to be supplied to said first video memory.

6. A video display apparatus as claimed in claim 5, further comprising:

a processor for executing arithmetic and logical operations; and a bus for connecting said processor with said plurality of video memories and connecting said processor with said memory control means; and wherein said processor comprises means for changing a value of said integer N1 in said first PLL circuit to scale a first video image in a horizontal direction, said first video image being represented by a first video signal read out of said first video memory.

7. A video display apparatus as claimed in claim 6, wherein said video control signal generation means comprises means for generating a second signal having a second period which corresponds to a scanning time for one display screen of said display means; and said memory control means further comprises:

means for generating from said first signal supplied from said video control signal generation means a first scanning-line update signal indicating a timing which corresponds to an end of one scanning line for said first video signal read out of said first video memory; and a second PLL circuit for generating from one of said first and second signals a second scanning-line update signal having a period which is N2 times the second period of said second signal, where N2 is an integer; and wherein said horizontal address generation means comprises means for resetting said horizontal address to a predetermined initial value in response to each pulse of said first scanning-line update signal; and said vertical address generation means comprises vertical address update means for updating said vertical address by adding an address increase to said vertical address in response to each pulse of said first scanning-line update signal, said address increase being a product of an address difference corresponding to a predetermined number of scanning lines on said display screen and the number of pulses of said second scanning-line update signal which are occurred between latest two pulses of said first scanning-line update signal.

8. A video display apparatus as claimed in claim 7, wherein said processor comprises means for changing a value of said integer N2 in said second PLL circuit to scale said first video image in a vertical direction.

9. A computer system comprising:

display means including a display screen for displaying a video image;

a plurality of video memories for storing a plurality of video signals, respectively;

video control signal generation means for generating a plurality of read-permit signals indicating times for reading said plurality of video signals from said plurality of video memories, respectively;

memory control means for generating a plurality of read control signals from said plurality of read-permit signals and for supplying said plurality of read control signals to said plurality of video memories to allow said plurality of video signals to be read out of said plurality of video memories, said memory control means comprising means for generating a plurality of clock signals which are different from each other and respectively synchronous with said plurality of video signals read out of said plurality of video memories;

selection signal generating means for generating a video selection signal which indicates a change in selection of said plurality of video signals at a plurality of positions on the display screen;

first selection means for selecting one of said plurality of video signals in response to said video selection signal; and second selection means for selecting one of said plurality of clock signals corresponding to the one of said plurality of video signals selected by said first selection means in response to said video selection signal, wherein the video image displayed on said display screen is displayed as a function of the one of said plurality of video signals and the one of said plurality of clock signals selected by said first and second selection means, respectively.

10. A method for simultaneously displaying a plurality of video images on a display screen, the method comprising the steps of:

storing a plurality of video signals in a plurality of video memories;

generating a plurality of read-permit signals indicating times for reading said plurality of video signals from said plurality of video memories;

generating a plurality of read control signals from said plurality of read-permit signals;

supplying said plurality of read control signals to said plurality of video memories to cause said plurality of video signals to be read out of said plurality of video memories;

generating a plurality of clock signals which are different from each other and respectively synchronous with said plurality of video signals read out of said plurality of video memories;

generating a video selection signal which indicates a change in selection of said plurality of video signals at a plurality of positions on the display screen;

selecting one of said plurality of video signals in response to said video selection signal;

selecting one of said plurality of clock signals corresponding to the one of said plurality of video signals selected in response to said video selection signal; and displaying a video image as a function of said one of said plurality of video signals and said one of said plurality of clock signals selected in the selecting steps.

11. A method as claimed in claim 10, wherein said step of generating the video selection signal comprises the steps of:

providing a memory, having a memory area corresponding to a specific area including a plurality of pixels on the display screen, said memory being arranged to store video selection data which indicates to select one of said plurality of video signals for each of said plurality of pixels; and supplying a selection-data read control signal to said memory to read out said video selection data from said memory as said video selection signal.

12. A method as claimed in claim 11, wherein said step of supplying the selection-data read control signal comprises the step of transmitting one of said plurality of read control signals to said memory as said selection-data read control signal.

13. A method as claimed in claim 10, wherein said step of displaying the video image comprises the step of converting a selected digital video signal to an analog video signal in response to said selected clock signal.

14. A method as claimed in claim 10 wherein said step of generating the plurality of read-permit signals comprises the step of generating a first signal having a first period which corresponds to a scanning time for one scanning line on the display screen; and said step of generating the plurality of read control signals comprises the steps of:

generating from said first signal a first clock signal having a period which is N1 times the first period of said first signal, where N1 is an integer;

generating a horizontal address for said first video memory, and increasing said horizontal address in response to each pulse of said first clock signal;

generating a vertical address for a first video memory of said plurality of video memories; and combining said vertical address and said horizontal address to produce an address to be supplied to said first video memory.

15. A method as claimed in claim 14, further comprising the step of changing a value of said integer N1 to scale a first video image in a horizontal direction, said first video image being represented by a first video signal read out of said first video memory.

16. A method as claimed in claim 15, wherein said step of generating the plurality of read-permit signals comprises the step of generating a second signal having a second period which corresponds to a scanning time for one display screen of said display means; and said step of generating the plurality of read control signals further comprises the steps of:

generating from said first signal a first scanning-line update signal indicating a timing which corresponds to an end of one scanning line for said first video signal read out of said first video memory; and generating from one of said first and second signals a second scanning-line update signal having a period which is N2 times the second period of said second signal, where N2 is an integer; and said step of generating the horizontal address comprises the step of resetting said horizontal address to a predetermined initial value in response to each pulse of said first scanning-line update signal; and said step of generating the vertical address comprises the step of updating said vertical address by adding an address increase to said vertical address in response to each pulse of said first scanning-line update signal, said address increase being a product of an address difference corresponding to a predetermined number of scanning lines on said display screen and the number of pulses of said second scanning-line update signal which are occurred between latest two pulses of said first scanning-line update signal.

17. A method as claimed in claim 16, further comprising the step of changing a value of said integer N2 to scale said first video image in a vertical direction.

* * * * *